US008955689B2

(12) United States Patent
Couture

(10) Patent No.: US 8,955,689 B2
(45) Date of Patent: Feb. 17, 2015

(54) APPARATUS, PROPULSIVE ELEMENT AND METHOD FOR PROCESSING NON-CONSOLIDATED MATERIALS

(76) Inventor: Michel Couture, Blainville (CA)

( * ) Notice: Subject to any disclaimer, the term of this patent is extended or adjusted under 35 U.S.C. 154(b) by 1061 days.

(21) Appl. No.: 12/737,534

(22) PCT Filed: Jul. 23, 2009

(86) PCT No.: PCT/CA2009/001027

§ 371 (c)(1),
(2), (4) Date: Jan. 21, 2011

(87) PCT Pub. No.: WO2010/009546

PCT Pub. Date: Jan. 28, 2010

(65) Prior Publication Data

US 2011/0113749 A1 May 19, 2011

(30) Foreign Application Priority Data

Jul. 23, 2008 (CA) ..... 2636709

(51) Int. Cl.

| | |
|---|---|
| ***B07B 4/02*** | (2006.01) |
| ***B01F 5/24*** | (2006.01) |
| ***B01F 13/02*** | (2006.01) |

(52) U.S. Cl.

CPC ... *B07B 4/02* (2013.01); *B01F 5/24* (2013.01); *B01F 13/0227* (2013.01)

USPC ..... 209/639; 209/44.2; 209/644

(58) Field of Classification Search

USPC ..... 209/44.2, 639, 644, 932

See application file for complete search history.

(56) References Cited

U.S. PATENT DOCUMENTS

| | | | | |
|---|---|---|---|---|
| 2,389,966 | A * | 11/1945 | Erickson | 209/25 |
| 5,791,489 | A * | 8/1998 | Leifeld | 209/44.1 |
| 5,819,373 | A * | 10/1998 | Schlichter et al. | 19/205 |
| 6,405,405 | B1 * | 6/2002 | Hauch | 15/309.2 |
| 7,506,764 | B2 * | 3/2009 | Couture | 209/21 |
| 8,123,041 | B2 * | 2/2012 | Vladimir | 209/157 |

* cited by examiner

*Primary Examiner* — Joseph C Rodriguez

(57) ABSTRACT

A propulsive element usable for producing a jet of fluid using a pressurized fluid. An inlet receives the pressurized fluid; a propulsive element passageway extends from the inlet; two main outlets are in fluid communication with the propulsive element passageway and are configured and sized for releasing each a respective main jet portion when the pressurized fluid is injected in the inlet, the two main jet portions being each substantially divergent, the two main jet portions creating a low pressure zone therebetween.

16 Claims, 19 Drawing Sheets

17
17
17
80
80
80
80
45
100
104
88
64
102
68
64
66
66
70
84
78
78
48
105
48

136
130
138
134
24
26
36
132
140
144
146
126
118
128

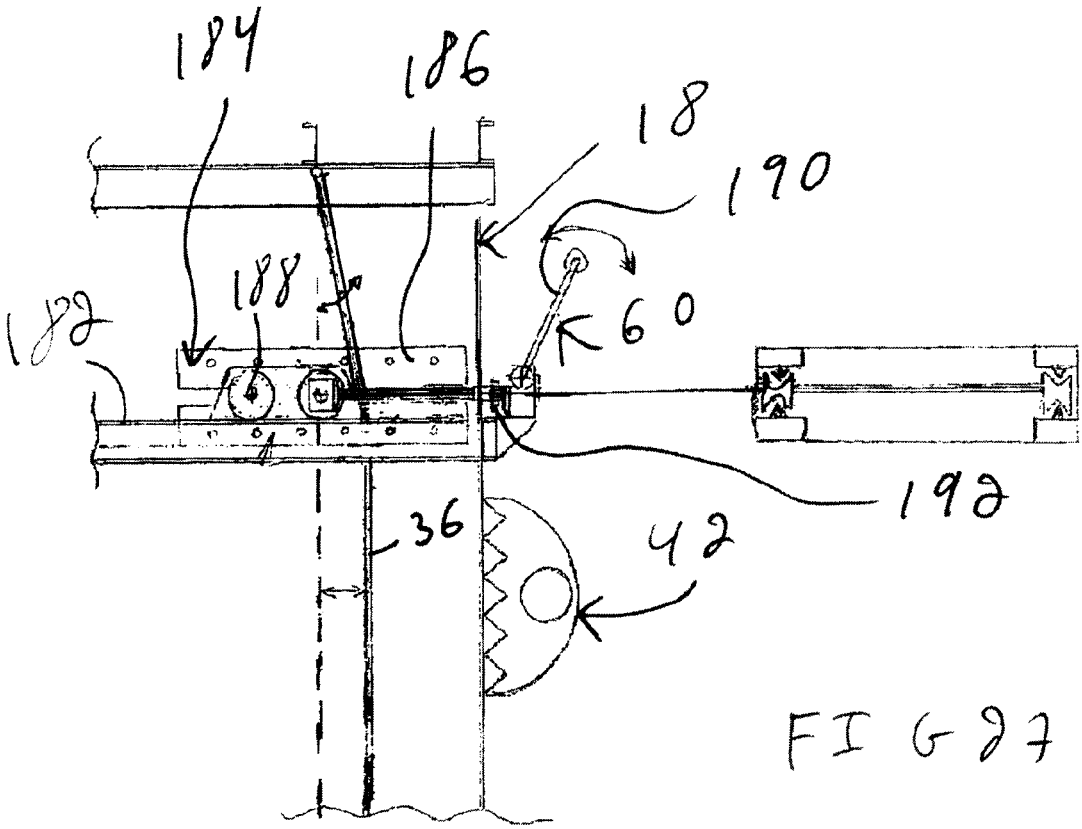
FIG 27
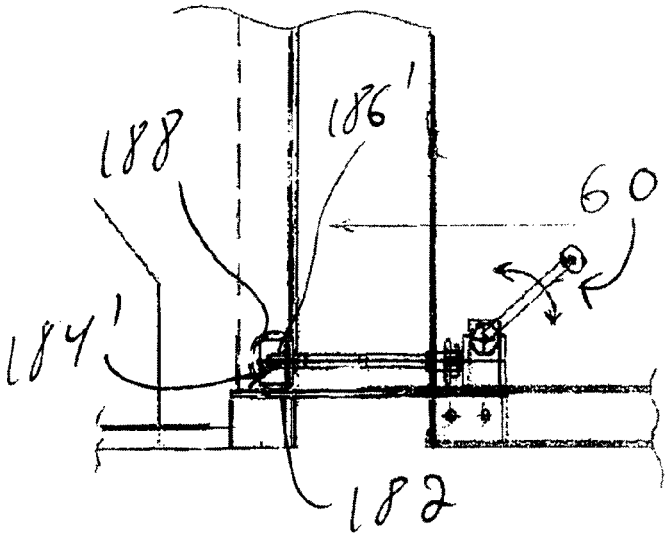

APPARATUS, PROPULSIVE ELEMENT AND METHOD FOR PROCESSING NON-CONSOLIDATED MATERIALS

FIELD OF THE INVENTION

The present invention relates to the general field of processes used for processing non-consolidated materials and is particularly concerned with an apparatus, a propulsive element and a method for processing non-consolidated materials.

BACKGROUND OF THE INVENTION

There exists a multitude of devices for processing granular and other non-consolidated materials. These devices are used for mixing particles contained in a stream of granular material, separating particles having predetermined properties from a stream of granular material, or treating the granular material by coating constituent particles with a fluid or in any other manner. Some of these devices use a fluid, such as air, blown on the particles to process them. In some cases, devices suck the particles to filtrate or cyclonically process them. A drawback of existing devices is that inhomogeneities in the processed particles create inefficiencies in the process. Another drawback of existing devices is that typically, only relatively small quantities of granular material are processed in any given amount of time. This is caused by the fact that using large volumes of fluids or high velocity fluids typically results in non-selective processing of the particles, which is often undesirable, especially in separation processes.

For example, in some processes, particles of a granular material in freefall are separated according to size by blowing air on them in the direction substantially perpendicular to the freefall. In this case, if the flow rate of the air is too large, all the particles are moved perpendicularly to the freefall and no separation occurs. If the flow rate is relatively small, but the speed of the air is relatively large, the same effect typically occurs, or, if a successful separation is achieved, only relatively small amounts of particles can be processed in any given amount of time. There are currently no devices that can separate particles streams according to particle size at large flow rates using this method. Also, to work properly, these processes require that the material to process be significantly diluted. For example, bulk crushed stone is too compact to be processed in this manner.

Also, many applications, including, but not limited to, material processing, are more successful if large volumes of air or other fluid are blown at high velocities. Producing such flows of air economically is relatively difficult.

Against this background, there exists a need in the industry to provide a new and improved apparatuses and methods for processing non-consolidated materials. There exists also a need in the industry to provide new apparatuses and methods for projecting fluids, such as gases, at high velocity and relatively high or small flow rates.

An object of the present invention is therefore to provide new and improved apparatuses and methods for processing non-consolidated material. Another object of the present invention is therefore to provide new and improved apparatuses and methods for projecting fluids, such as gases, at at high velocity and relatively high or small flow rates.

SUMMARY OF THE INVENTION

In a first broad aspect, the invention provides a propulsive element usable for producing a jet of fluid using a pressurized fluid, the propulsive element comprising: an inlet for receiving the pressurized fluid; a propulsive element passageway extending from the propulsive element inlet; two main outlets in fluid communication with the propulsive element passageway and located substantially opposed to the inlet relative to the propulsive element passageway, the two main outlets being configured and sized such that the two main outlets release each a respective main jet portion when the pressurized fluid is injected in the inlet, the two main jet portions being each substantially divergent, the two main jet portions creating a low pressure zone therebetween; and an auxiliary outlet located between the two main outlets, the auxiliary outlet being in fluid communication with the propulsive element passageway and located substantially opposed to the inlet relative to the propulsive element passageway, the auxiliary outlet being configured and sized such that the auxiliary outlet releases an auxiliary jet portion when the pressurized fluid is injected in the inlet, the auxiliary jet portion being released in the low pressure zone. The auxiliary jet portion has a flow rate, a velocity, a configuration and dimensions such that forces exerted on the two main jet portions by the low pressure zone are reduced by the release of the auxiliary jet portion in the low pressure zone so as to reduce turbulence in the two main jet portions substantially adjacent to the two main outlets.

For the purpose of this document, the term jet is used to mean a stream of a fluid, either liquid or gas, forcefully shooting forth from a propulsive element. The low pressure zone is at a pressure lower than surrounding regions, such as the two main jet portions and, in some embodiments, ambient air.

Typically, the two main jet portions move at relatively high speed, for example 100 m/s or more, and, in some embodiments, are produced at the two main outlets at supersonic speed. Since the main jet portions move rapidly through ambient air, the low pressure zone is created therebetween. The low pressure zone, in turn, creates relatively large turbulence in the main jet portions. This turbulence slows down the main jet portions relatively quickly. It was found that surprisingly, injecting the auxiliary jet portions that each typically have relatively low speed and relatively low flow rates reduces greatly this turbulence, which allows the main jet portions to merge with each other and form the jet of fluid having relatively large mass flow rate and velocity.

Advantageously, the proposed propulsive element is manufacturable relatively easily and produces jet of fluids having remarkable properties at relatively low costs and relatively efficiently.

In another broad aspect, the invention provides a method for producing a jet of fluid using a propulsive element, the propulsive element including two main outlets and an auxiliary outlet located between the two main outlets. The method includes pushing the fluid through the two main outlets to create two main jet portions, the two main jet portions being each substantially divergent, the two main jet portions having a velocity, a configuration and dimensions such that a low pressure zone is created therebetween; and pushing the fluid through the auxiliary outlet to create an auxiliary jet portion, the auxiliary jet portion being released in the low pressure zone, the auxiliary jet portion having a velocity, a configuration, dimensions and a flow rate such that forces exerted on the two main jet portions by the low pressure zone are reduced by the auxiliary jet so as to reduce turbulence in the two main jet portions and increase flow rate, dimensions and speed in the jet of fluid after their unification.

The jet of fluid produced with the proposed method is usable for mixing, separating or treating non-consolidated materials. For the purpose of this document, non-consolidated materials constitutes any materials that are not in a single solid piece of material. Examples of non-consolidated materials include granular materials and fluids, among other possibilities.

In another broad aspect, in invention provides an apparatus for processing a stream of non-consolidated material, the apparatus being usable with a source of pressurized fluid. The apparatus includes a substantially upstanding casing, the casing defining a casing inlet, a casing outlet and a proximal chamber extending therebetween, the casing inlet being located above the casing outlet; a distributor located above the casing inlet for receiving the stream of non-consolidated material and distributing the stream of non-consolidated material substantially uniformly over the casing inlet; and a propulsive element, the propulsive element defining a propulsive element inlet couplable in fluid communication with the source of pressurized fluid for receiving the pressurized fluid, the propulsive element defining a propulsive element outlet for releasing a jet of fluid when the propulsive element inlet receives the pressurized fluid, the propulsive element being operatively coupled to the casing for releasing the jet of fluid in the proximal chamber.

In some embodiments of the invention, the proposed apparatus uses the propulsive element described hereinabove. The proposed apparatus is usable, for example, to separate, mix or treat the constituent particles of the non-cohesive material.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

In the appended drawings:

FIG. 27, in a side schematic cross-sectional view, illustrates an actuator part of the apparatus shown in FIGS. 1 and 2;

DETAILED DESCRIPTION

In this document, side elevation views are shown in most drawings with the understanding that typically, the structures described in this document extend substantially the whole width of the apparatus 10 described herein in a direction perpendicular to the illustrated cross-section. This is illustrated for some structures when comparing FIGS. 1 and 2. Also, directional terminology, such as "up", "down" "vertical", and "horizontal" among others, is used in this document for clarity the purposes and relates to the orientation of the apparatus 10 in typical use. This terminology should not be used to restrict the scope of the claimed invention.

Figure 1:
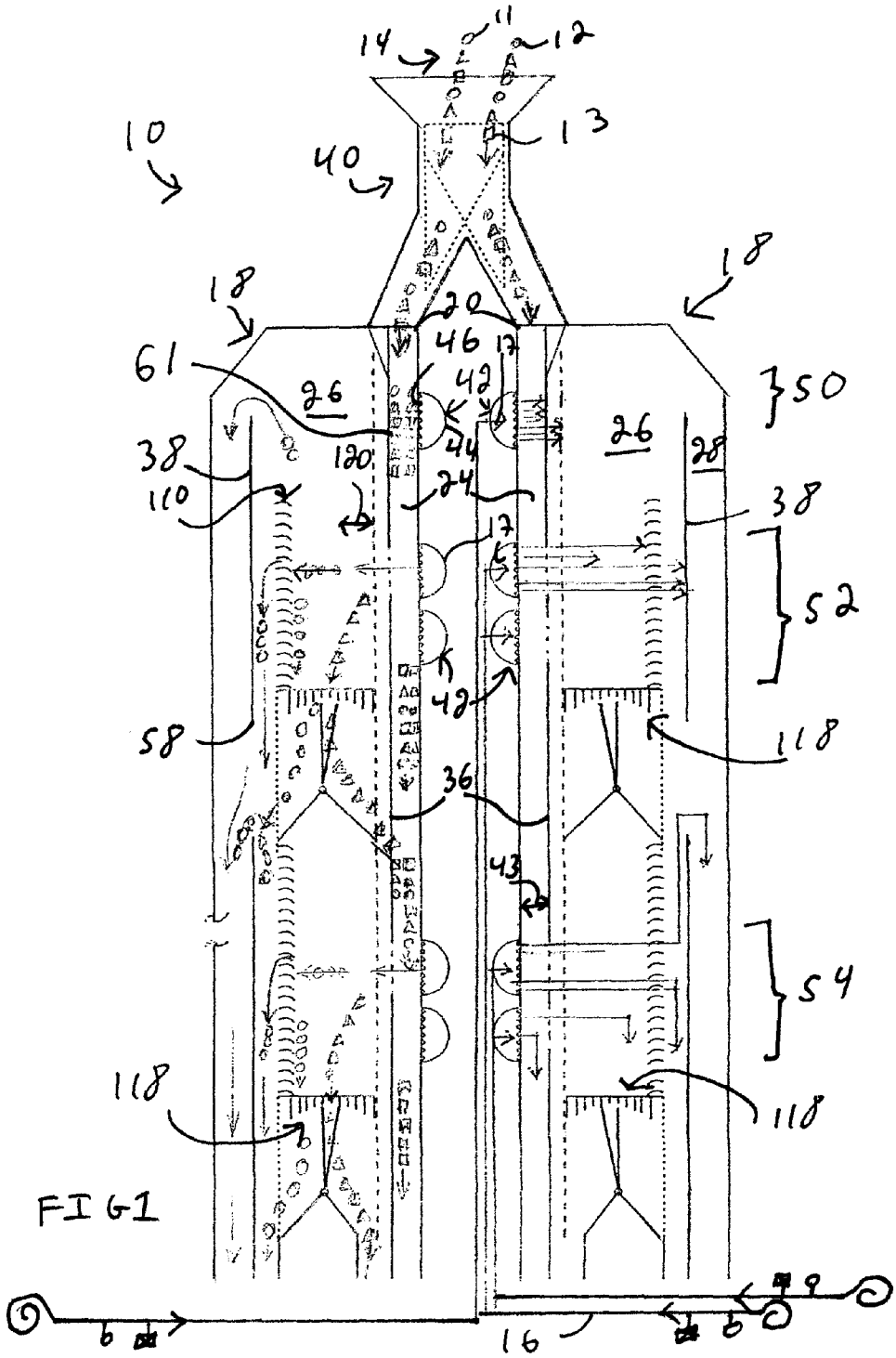
FIG. 1, in side cross-sectional schematic view, illustrates an apparatus for processing a stream of material in accordance with an embodiment of the present invention.

FIG. 1 illustrates an apparatus 10 for processing a non-consolidated material 14. The apparatus 10 is typically manufactured using steel or any impact resistant material able to withstand the forces generated in the apparatus 10 when in use. Here, the non-consolidated material 14 is a granular material shown having three different types of constituent particles 11, 12 and 13 illustrated respectively by circles, triangles and squares. This illustration is not necessarily representative of the shapes of these particles, which could have any shapes, dimensions and weights, and is used for illustrative purposes only. Also, while a granular material is used to illustrate a process performed by the apparatus 10, in alternative embodiments of the invention, any other suitable non-consolidated material 14 that is not a single solid mass can be processed. An example of such a material would be a fluid, such as, for example, a liquid.

Returning to FIG. 1, the apparatus 10 is usable with a source of pressurized fluid 16. The source of pressurized fluid 16 includes all the equipment required to produce a pressurized fluid 17, such as, for example, compressed air, and convey this pressurized fluid 17 to the apparatus 10. For example, and non-limitingly, the source of pressurized fluid 16 includes a turbofan compressor, piping, valves and pressure measuring equipment. Source of pressurized fluid 16 are well known in the art and the source of pressurized fluid 16 will therefore not be described in further details.

The apparatus 10 includes at least one substantially upstanding casing 18. The casing 18 defines a casing inlet 20, a casing outlet 22 and a proximal chamber 24 extending therebetween. The casing inlet 20 is located above the casing outlet 22 (seen in FIG. 2). While the terminology proximal suggests that other chambers may be present in the apparatus 10, which is the case in the specific apparatus 10 shown in the drawings, in alternative embodiments of the invention, only one chamber is provided in the casing 18. In the apparatus 10, intermediate and distal chambers 26 and 28 are provided in the casing 18. The proximal, intermediate and distal chambers 24, 26 and 28 define respectively proximal, intermediate and distal chamber outlets 30, 32, 34 substantially adjacent the bottom end thereof. Typically, two intermediate chamber outlets 32 and 33 are defined, one substantially adjacent the proximal chamber 24 and the other substantially adjacent the distal chamber 28. Also, typically, a distributor 40 is located above the casing inlet 20 for receiving the non-consolidated material 14 and distributing the non-consolidated material 14 substantially uniformly over the casing inlet 20.

Many variants are possible for the apparatus 10. For example, typically, the casing 18 has a substantially rectangular horizontal cross-sectional area. However, other configurations are within the scope of the invention. Also, the apparatus 10 is illustrated as including a pair of substantially upstanding casings 18, each similar to the casing 18 described hereinabove, but any other suitable number of casings 18 is usable. Finally, it was found that having casings 18 defining proximal chambers that are at least about 10 meters high provided good results. However, other heights are within the scope of the invention.

At least one propulsive element 42 is provided. Each propulsive element 42 defines a propulsive element inlet 44 couplable in fluid communication with the source of pressurized fluid 16 for receiving the pressurized fluid 17. The propulsive element 42 also defines a propulsive element outlet 46 for releasing a jet of fluid 48 (seen in FIG. 1), when the propulsive element inlet 44 receives the pressurized fluid 17, the propulsive element 42 being operatively coupled to the casing 18 for releasing the jet of fluid 48 in the proximal chamber 24. The terminology "propulsive element" is used in this document to emphasize that the fluid is projected at relatively high velocity and flow rates in typical applications of the propulsive element 42. The propulsive elements 42 can therefore be considered as very high performance multi-section nozzles joined together.

In some embodiments of the invention, many propulsive elements 42 are provided. These propulsive elements 42 are typically disposed substantially vertically spaced apart from each other. In some embodiments, three stages of propulsive elements 50, 52 and 54 are provided, including respectively one, two and two propulsive elements 42. Propulsive elements 42 within each stage of propulsive elements 50, 52 and 54 are distanced from each other by a distance smaller than propulsive elements 42 belonging to different stages of propulsive elements 50, 52 and 54.

Typically, the propulsive elements 42 are each operatively coupled to the casing 18 for releasing the jet of fluid 48 in the proximal chamber 24 substantially horizontally. However, in alternative embodiments of the invention, the propulsive elements 42 are each operatively coupled to the casing 18 for releasing the jet of fluid 48 in the proximal chamber 24 in any other suitable orientation.

The casing 18 and structures associated with the casing 18 are now described in further details. The intermediate and distal chambers 26 and 28 are substantially vertically extending and substantially parallel to the proximal chamber 24. The intermediate chamber 26 is located between the proximal and distal chambers 24 and 28. A proximal-to-intermediate wall 36 extends substantially vertically in the casing 18 between the proximal and intermediate chambers 24 and 26. An intermediate-to-distal wall 38 extends substantially vertically in the casing 18 between the intermediate and distal chambers 26 and 28.

In some embodiments of the invention, the proximal-to-intermediate wall 36 is movable substantially horizontally in the casing 18 to change a distance between the propulsive elements 42 and the proximal-to-intermediate wall 36. Moving the proximal-to-intermediate wall 36 wall substantially horizontally in the casing 18 changes transversal cross-sectional areas of both the proximal and intermediate chambers 24 and 26. Typically, an actuator 60, described in further details hereinbelow, is provided for moving the proximal-to-intermediate wall 36 substantially horizontally relatively to the casing 18. A specific embodiment of the invention that was found to provide good results includes a proximal-to-intermediate wall 36 that is movable such that a proximal-to-intermediate wall-to-propulsive element distance 43 between the propulsive element outlet 46 and the proximal-to-intermediate wall 36 is variable from about 15 cm to about 30 cm. However, other movement ranges for the proximal-to-intermediate wall 36 are within the scope of the invention.

In some embodiments of the invention, a substantially planar surface 61 substantially horizontally opposed to the propulsive element 42 from the first stage of propulsive elements 50 is defined by the proximal-to-intermediate wall 36 propulsive element 42 from the first stage of propulsive elements 42. For example, the planar surface 61 is substantially vertical.

The casing 18, the proximal-to-intermediate wall 36 and the intermediate-to-distal wall 38 are provided with various apertures to allow the transfer of fluids and other processed materials in the apparatus 10. The casing 18 defines propulsive element receiving apertures 51, better illustrated in FIG. 2, leading into the proximal chamber 24 substantially opposed to the proximal-to-intermediate wall 36 for each propulsive element 42. The propulsive element outlet 46 of each propulsive element 42 is substantially in register with a respective one of the propulsive element receiving apertures 51.

Figure 2:
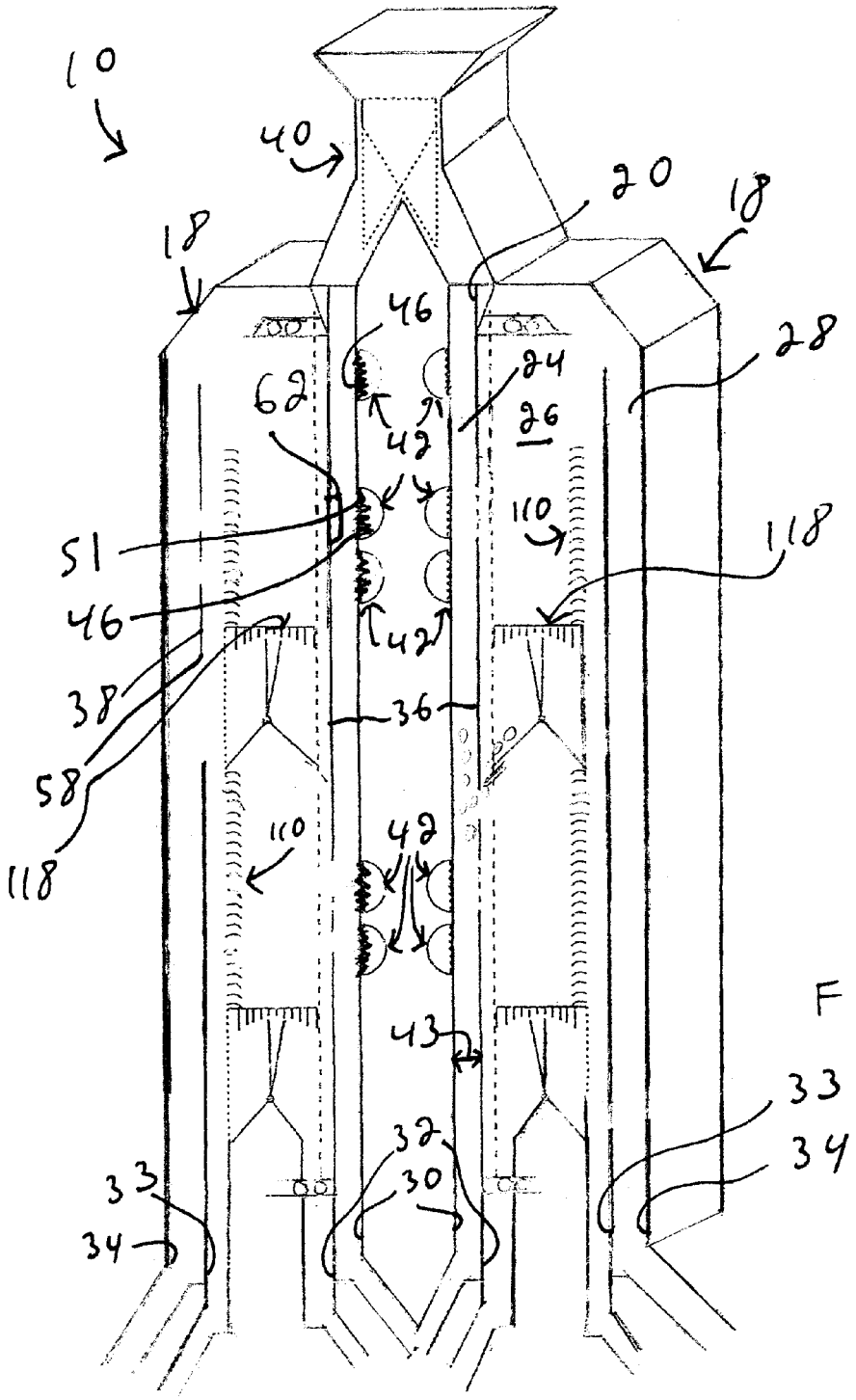
FIG. 2, in perspective schematic view with parts removed, illustrates the apparatus of FIG. 1.

Typically, at least one proximal-to-intermediate chamber transfer aperture 56, better seen in FIG. 1, is provided in the proximal-to-intermediate wall 36 substantially horizontally opposed to at least one of the propulsive elements 42 from the second and third stages of propulsive elements 52 and 54. Each proximal-to-intermediate chamber transfer aperture 56 is provided for allowing transfer of materials projected by the jet of fluid 48 from the proximal chamber 24 to the intermediate chamber 26. In some embodiments of the invention, a panel 62, seen in FIG. 2, is removably attachable to each proximal-to-intermediate wall 36 for selectively obstructing the proximal-to-intermediate chamber transfer aperture 56. In alternative embodiments of the invention, the panel 62 is replaced by a grid, not shown in the drawings.

The intermediate-to-distal wall 38 defines at least one intermediate-to-distal chamber transfer aperture 58 extending therethrough at a lever lower than the proximal-to-intermediate chamber transfer aperture 56. Other locations for the intermediate-to-distal chamber transfer aperture 58, for example locations in which the intermediate-to-distal chamber transfer aperture 58 is located substantially vertically offset from the propulsive element receiving apertures 51 are also within the scope of the invention. The intermediate-to-distal chamber transfer aperture 58 is provided for allowing transfer of the fluid from the intermediate chamber 26 to the distal chamber 28, thereby reducing pressure build up in the intermediate chamber 26.

Figure 4:
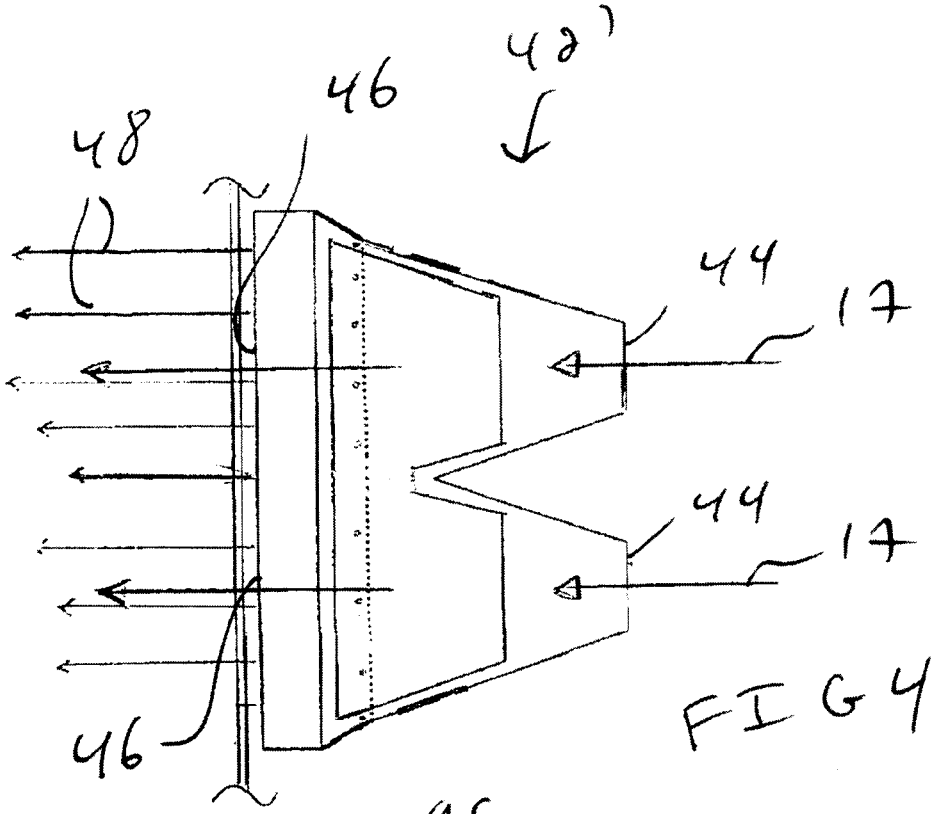
FIG. 4, in a side elevation view, illustrates an alternative propulsive element part of the apparatus shown in FIGS. 1 and 2.

As mentioned hereinabove, the propulsive elements 42 are usable for producing the jet of fluid 48 using the pressurized fluid 17 provided by the source of pressurized fluid 16. Each propulsive element 42 includes the propulsive element inlet 44 for receiving the pressurized fluid 17, a propulsive element passageway 45 extending from the propulsive element inlet 44 and the propulsive element outlet 46. For example, in some embodiments of the invention, the propulsive element passageway has dimensions of the order of 200 mm substantially adjacent to the propulsive element inlet 44 and expends to a dimension of about 350 mm by 650 mm substantially adjacent to the propulsive element outlet 46. The propulsive element outlet 46 is located substantially opposed to the propulsive element inlet 44 relative to the propulsive element passageway 45. In a specific embodiment of the invention, the propulsive element 42 is as described in the following paragraphs. However, in alternative embodiments of the invention, other suitable propulsive elements are usable. Also, as seen in FIG. 4, in some embodiments of the invention, alternative propulsive elements 42' include more than one propulsive element inlet 44. These embodiments are useful, for example, to provide propulsive element stages 52, 54 using many jet of fluids 48 with a single propulsive element 42'.

Figure 5:
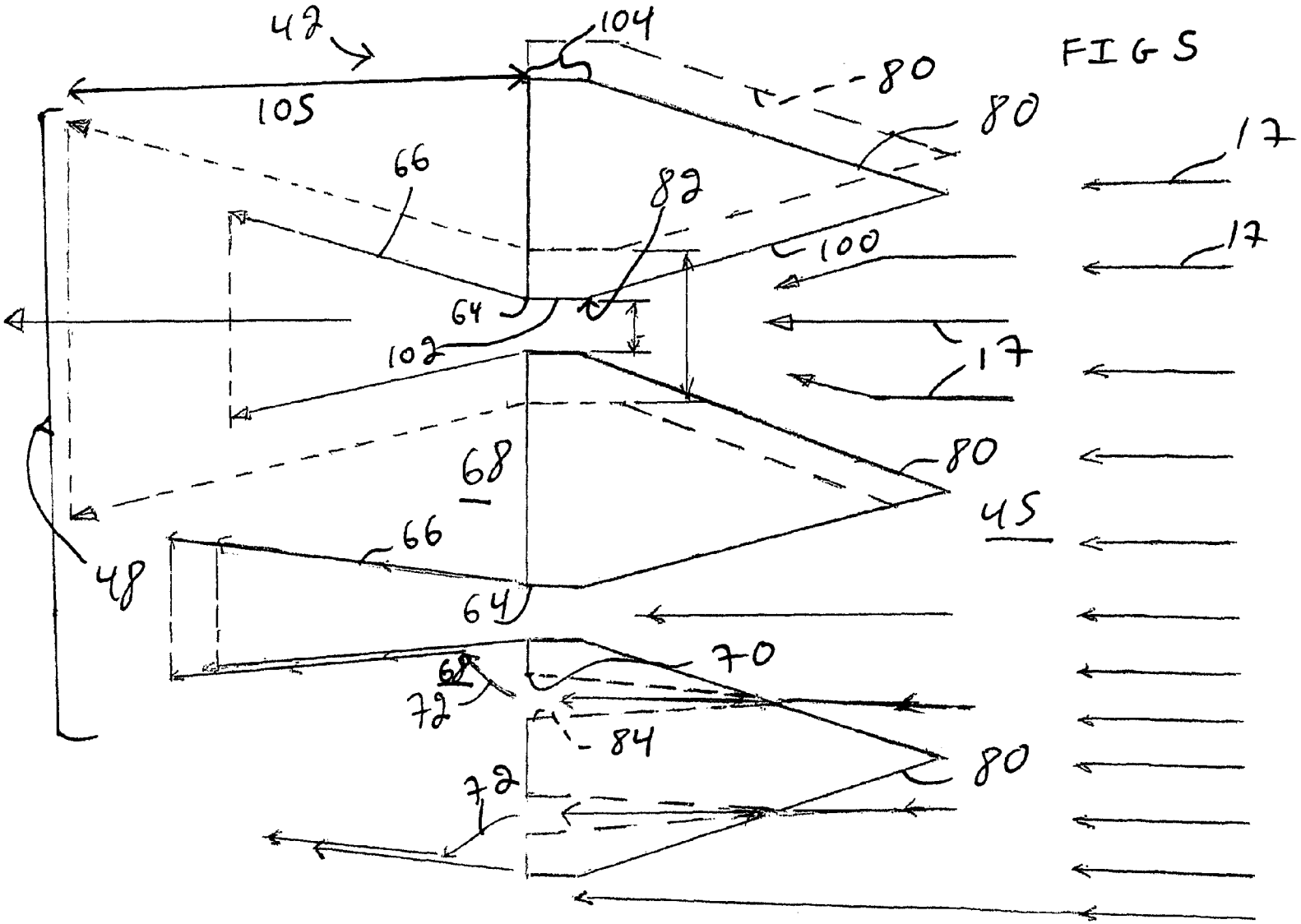
FIG. 5, in a side cross-sectional schematic view, illustrates part of the propulsive element shown in FIG. 3.

FIG. 5 illustrates the basic concepts associated with a proposed innovative propulsive element 42. While the propulsive element 42 is described in the context of the apparatus 10, the reader skilled in the art will readily appreciate that the propulsive element 42 is also usable for many other applications in which the jet of fluid 48 is to be produced.

The propulsive element outlet 46 is divided into at least two main outlets 64 in fluid communication with the propulsive element passageway 45 substantially opposed to the propulsive element inlet 44. The two main outlets 64 are configured and sized such that the two main outlets 64 release each a respective main jet portion 66 when the pressurized fluid 17 is injected in the propulsive element inlet 44. The two main jet portions 66 are each substantially divergent in a direction leading away from the two main outlets 64. The two main jet portions 66 create a low pressure zone 68 therebetween. Typically, the two main jet portions 66 are substantially parallel to each other and are each divergent so that they are joined to each other to create the jet of fluid 48 after their unification.

The propulsive element outlet 46 also includes an auxiliary outlet 70 located between the two main outlets 64, the auxiliary outlet 70 being in fluid communication with the propulsive element passageway 45 substantially opposed to the propulsive element inlet 44 (not shown in FIG. 5). The auxiliary outlet 70 is configured and sized such that the auxiliary outlet 70 releases an auxiliary jet portion 72 when the pressurized fluid 17 is injected in the propulsive element inlet 44, the auxiliary jet portion 72 being released in the low pressure zone 68.

The auxiliary jet portion 72 has a flow rate, a velocity, a configuration and dimensions such that forces exerted on the two main jet portions 66 by the low pressure zone 68 are reduced by the auxiliary jet portion 72 which are captured by the main jet portions 66 so as to reduce turbulence in the two main jet portions 66 substantially adjacent to the two main outlets 64. Typically, the auxiliary outlet 70 in smaller in cross-sectional area than each of the main outlets 64.

The reader skilled in the art will readily appreciate that the two main outlets 64 and the auxiliary outlet 70 are in fact portions of the propulsive element outlet 46. However, the word "portion" is omitted in this document to facilitate reading and understanding of the main concepts involved in the process performed by the propulsive element 42.

Figure 6:
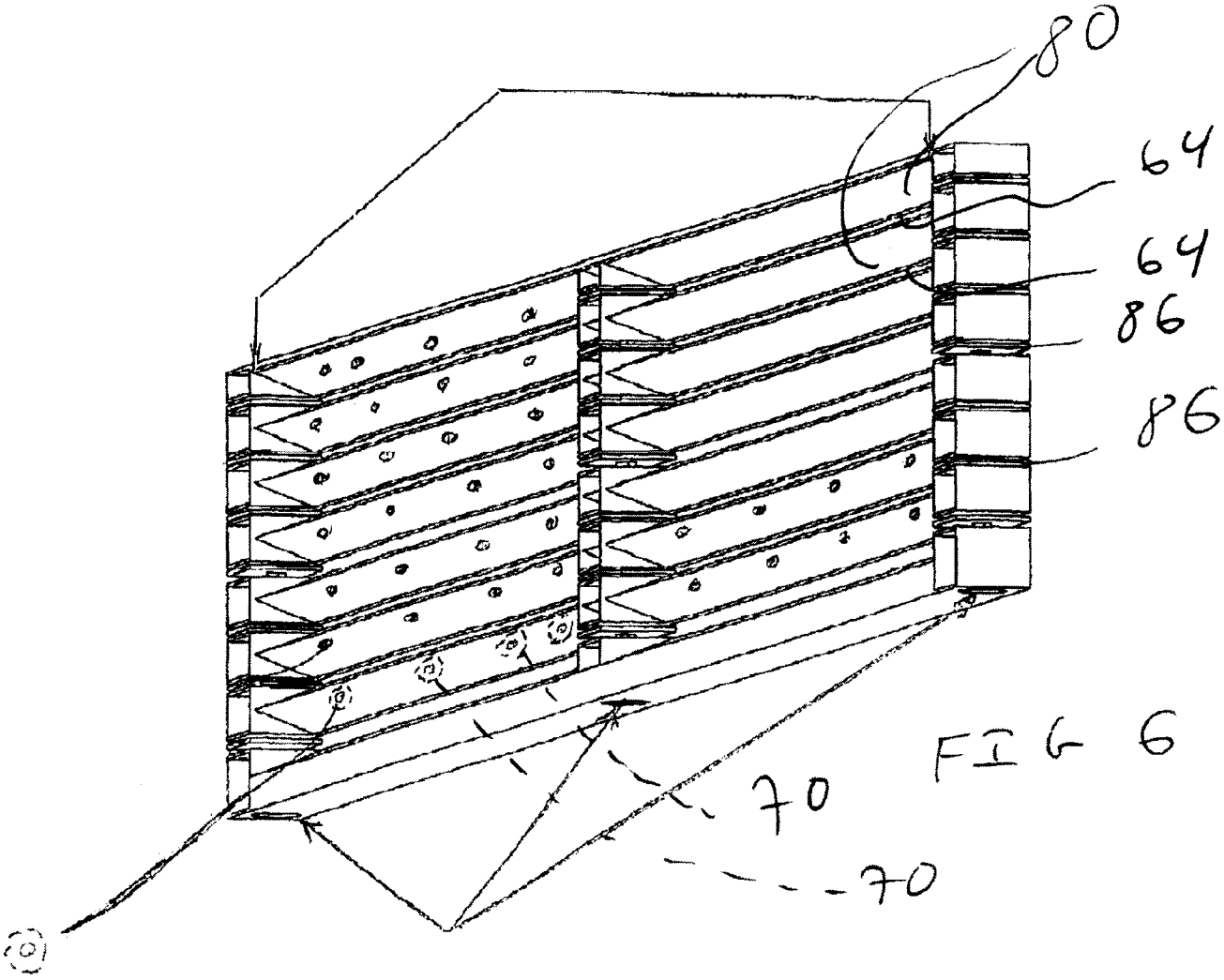
FIG. 6, in a perspective view, illustrates blades part of the propulsive element shown in FIG. 3.

As seen in FIG. 6, the propulsive element 42 typically includes more than two main outlets 64 and more than one auxiliary outlet 70. Indeed, typically a plurality of auxiliary outlets 70 are each located between two adjacent main outlets. The auxiliary outlets 70 are each in fluid communication with the propulsive element passageway 45 substantially opposed to the propulsive element inlet 44 (now shown in FIG. 6). The auxiliary outlets 70 are each configured and sized such that each auxiliary outlet 70 releases an auxiliary jet portion 72 when the pressurized fluid 17 is injected in the propulsive element inlet 44 (not shown in FIG. 6), the auxiliary jet portions 72 being released in the low pressure zone 68.

Also, a plurality of main outlets 64 are typically provided, each being in fluid communication with the propulsive element passageway 45 substantially opposed to the propulsive element inlet 44 (not shown in FIG. 6). Each of the main outlets 64 is configured and sized such that the main outlets 64 release each a respective main jet portion 66 (seen in FIG. 5) when the pressurized fluid 17 is injected in the propulsive element inlet 44. The main jet portions 66 are each substantially divergent in a direction leading away from the main outlets 64. The main jet portions 66 create a low pressure zone 68 between adjacent main jet portions 66. Typically, the main jet portions 66 are substantially parallel to each other before their unification. Auxiliary outlets 70 are provided between each pair of adjacent main outlets 64 formed by the plurality of main outlets 64, each auxiliary jet portion 72 being released in one of the low pressure zones.

Figure 3:
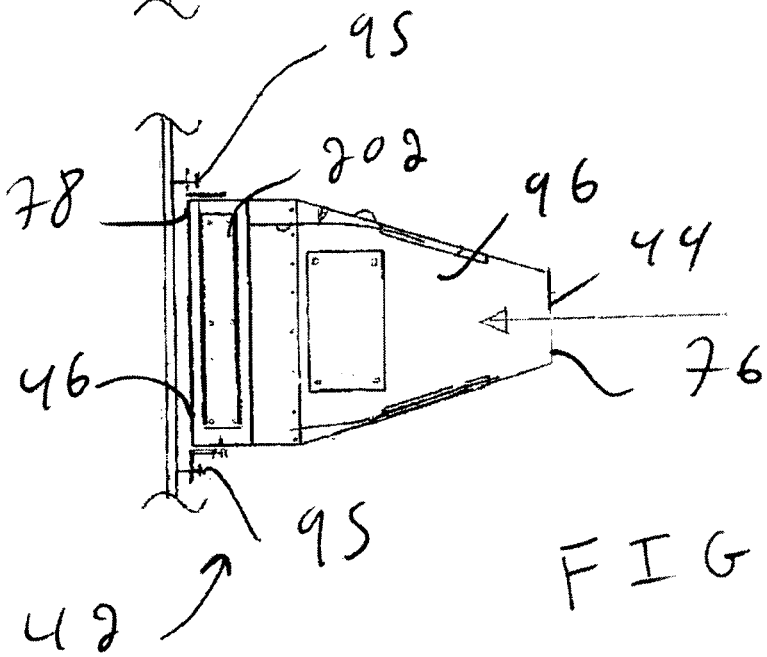
FIG. 3, in a side elevation view, illustrates a propulsive element part of the apparatus shown in FIGS. 1 and 2.

From a structural point of view, as seen in FIG. 3, the propulsive element 42 a propulsive element body 74 extending peripherally to the propulsive element passageway 45 (not shown in FIG. 3). The propulsive element body 74 defines a propulsive element body outlet end 78 substantially adjacent to the propulsive element inlet 44 and a propulsive element body outlet end 78 substantially opposed thereto.

Figure 29:
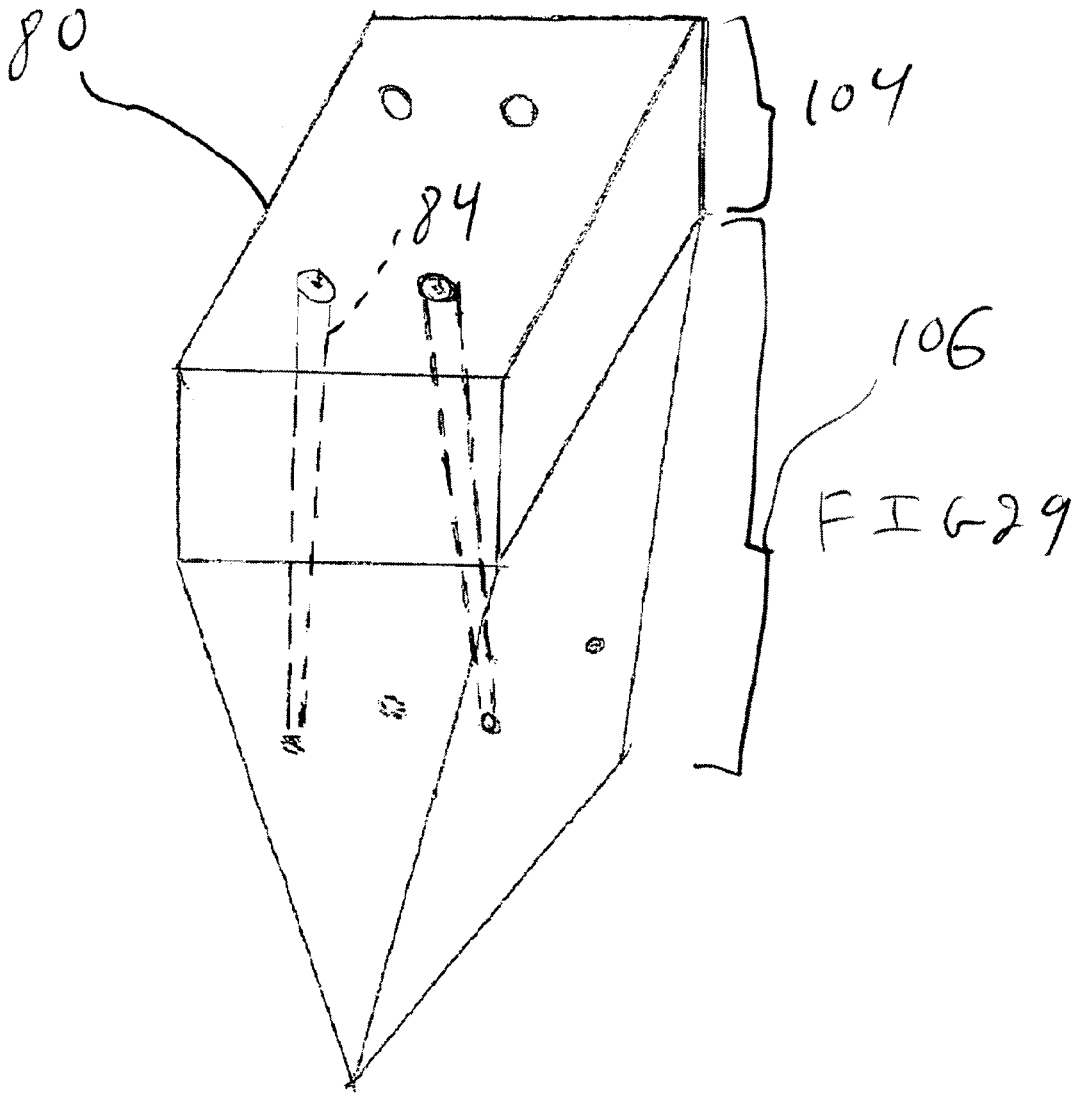
FIG. 29, in a perspective view, illustrates a blade similar to the blades shown in FIGS. 6 and 7.
Figure 31:
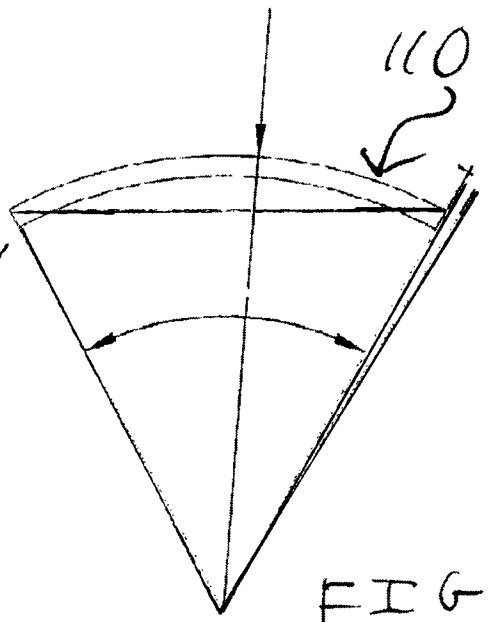
FIG. 31, in a side cross-sectional view, illustrates one of the fins shown in FIG. 30.

With reference to FIG. 6, substantially elongated blades 80 extend across the propulsive element passageway 45 (not shown in FIG. 6) in a substantially parallel and spaced apart relationship relative to each other substantially adjacent to the propulsive element body outlet end 78. The main outlets 64 are located between adjacent pairs blades 80. The blades define main outlet passageways 82 each extending between the propulsive element passageway 45 and a respective one of the main outlets 64. To enhance the efficiency of the blades, the blades are typically provided with a low-friction configuration surface. The auxiliary outlets are defined in the blades 80. More specifically, the blades 80 define each at least one, and typically a plurality of auxiliary outlet passageways 84 extending therethrough and leading each to a respective auxiliary outlet 70, as seen for example in FIG. 29.

Figure 7:
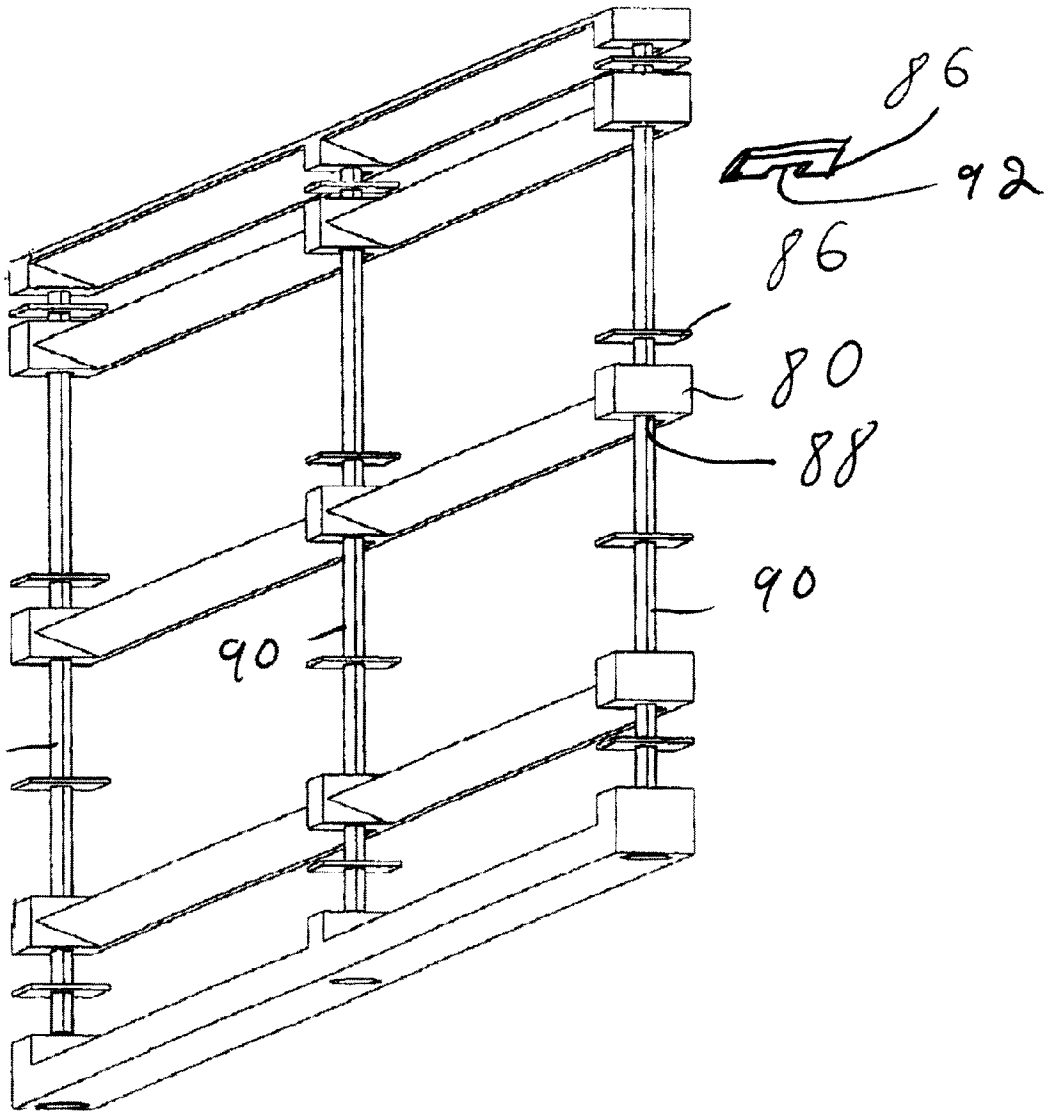
FIG. 7, in a perspective view with parts removed, illustrates blades part of the propulsive element shown in FIG. 3.
Figure 10:
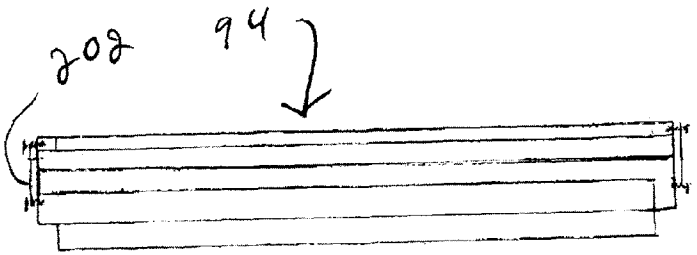
FIG. 10, in a top plan view, illustrates the propulsive element body shown in FIGS. 8 and 9.

FIG. 7 better illustrates the assembly of the blades 80. Spacing elements 86 between each pair of adjacent blades 80 for spacing the two adjacent blades 80 from each other. In some embodiments of the invention, the spacing element 86 are detachable, or otherwise removable from the base of the blades 80. In other words, the spacing elements 86 are removably inserted between the adjacent blades 80. However, in other embodiments of the invention, the spacing elements 86 are integrally formed to the blades 80. Use of the spacing elements 86 brings flexibility in dimensioning the main outlets 64. Indeed, not all main outlets 64 need to be dimensioned identically. Also, in some embodiments of the invention, obstructing plates (not shown in the drawings) are provided for obstructing some of the main outlets 64.

Typically, the blades 80 are substantially laterally movable relatively to each other so as to vary a distance between adjacent blades 80 to allow insertion of spacing elements 86 having different dimensions therebetween. This characteristic is shown in FIG. 5 in which one of the blades 80 has been shown in dashed lines in a translated position. For example, as seen in FIG. 7, this is achieved by having blades 80 defining a mounting aperture 88 extending substantially laterally therethrough. Mounting rods 90 are insertable through the mounting apertures 88. When the mounting rods 90 are inserted through the mounting apertures 88, the mounting apertures 88 of all the blades 80 are in register with each other. When the blades 80 and the spacing elements 86 are assembled, each spacing element 86 is substantially snugly received between two adjacent blades 80.

The spacing elements 86 are substantially planar and substantially U-shaped and define a recess 92 extending thereinto. The recess 92 receives the mounting rod 90 when the spacing elements 86 are operatively mounted between the blades 80. Since the spacing elements 86 and the blades 80 are movable along the mounting rods 90, spacing elements 86 having various thicknesses are usable for varying the distance between adjacent blades 80, and therefore adjusting the properties of the main and auxiliary jet portions 66 and 72.

Figure 8:
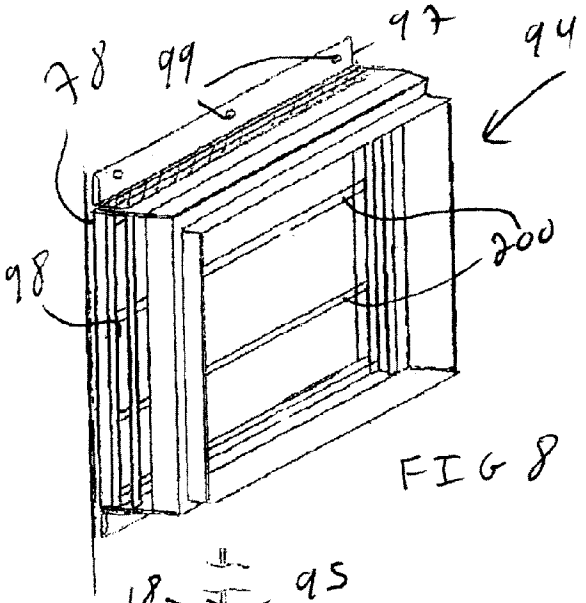
FIG. 8, in a perspective view, illustrates a propulsive element body part of the propulsive element shown in FIG. 3.
Figure 9:
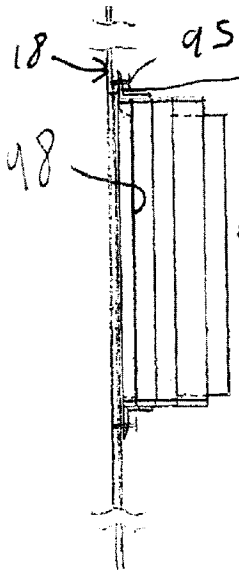
FIG. 9, in a side elevation view, illustrates the propulsive element body shown in FIG. 8.

With reference to FIG. 8, the propulsive element body 74 typically includes a mounting frame 94. The mounting frame 94 is covered by a propulsive element casing 96, seen in FIG. 3. The mounting frame 94 defines a mounting flange 97 substantially adjacent the propulsive element body inlet end 76 for mounting the mounting frame 94, and therefore the propulsive element 42, to the casing 18. For example, the mounting flange 97 defines through apertures 99 extending therethrough for receiving conventional fasteners 95. Guides 200 are provided for guiding the blades 80 and positioning them suitably in the mounting frame 94.

The mounting frame 94 defines a blade insertion aperture 98 extending substantially laterally thereinto substantially adjacent to the propulsive element body inlet end 76. The blades 80, when assembled and secured to each other as described hereinabove, are removably insertable through the blade insertion aperture 98 substantially jointly. The mounting rod 90 provides a blade attachment for removably attaching the blades 80 to each other, the blade insertion aperture being configured and sized for allowing joint movement of the blades 80 therethrough. For example, the blades 80 are biases towards each other by threading conventional nuts or similar fasteners at both ends of the mounting rods 90. Typically, the guides 200 are substantially elongated rails that extend substantially perpendicularly to the blade insertion aperture 98 substantially adjacent to the propulsive element body outlet end 78. A removable panel 202, seen in FIG. 3, is removably attached to the propulsive element casing 96 and covers the blade insertion aperture 98.

Referring to FIG. 5, each of the main outlet passageways 82 includes a respective main passageway tapered section 100 tapering in a direction leading from the propulsive element passageway 45 toward the main outlets 64. Each of the main outlet passageways 82 also includes a respective main passageway rectilinear section 102 having a substantially constant transversal cross-sectional configuration therealong. This structure is created by blades 80 having a substantially parallelepiped shaped section 104 from which extends a substantially triangular prism-shaped section 106, both seen also in FIG. 29. The main passageway rectilinear section 102 is located between the propulsive element passageway 45 and the main passageway tapered section 100. This structures create a propulsive element 42 wherein the main outlets 64 are substantially elongated and substantially parallel to each other.

As mentioned hereinabove, each of the blades 80 also defines the auxiliary outlet passageways 84. Typically, the auxiliary outlet passageways 84 extend between the main passageway tapered sections 100 and the auxiliary outlets 70, which are formed in the surface of the parallelepiped shaped section 104 distalmost to the propulsive element passageway 45. The auxiliary outlet passageways 84 each define an auxiliary passageway expanding section having a transversal cross-sectional area that increases in a direction leading from the propulsive element passageway 45 toward the auxiliary outlet 70. For example, the auxiliary outlet passageways 84 are each frusto-conical and the auxiliary passageway expanding section is formed by the entire auxiliary outlet passageways 84.

Typically, the main outlets 64 and the auxiliary outlets 70 are configured and sized such that the main jet portions 66 are joined together at a predetermined distance 105 from the main outlets 64 to form the jet of fluid 48. To achieve optimal results, the auxiliary outlets 70 are smaller in cross-sectional area than the main outlets 64. Also, the configuration of the blades 80 results in auxiliary jet portions 72 having a velocity smaller than the main jet portions 66.

In specific embodiments of the invention, the propulsive element 42 is configured and sized so as to produce a jet of fluid 48 having a jet flow rate, jet dimensions and a jet velocity able to create forces of a magnitude large enough to counteract the force of freefalling non-consolidated material to change the movement direction and move and project substantially horizontally over a predetermined distance the free falling non-consolidated material, for example granular minerals, having a density of at least 1 ton per cubic meter and a falling rate of at least 100 tons per hour.

In use, providing the pressurized fluid 17 to the propulsive element inlet 44 results in a method for producing a jet of fluid 48 by pushing the pressurized fluid 17 through the main outlets 64 to create the main jet portions 66 the main jet portions 66 having a velocity, a configuration and dimensions such that the low pressure zone 68 is created between adjacent main jet portions 66, and by pushing the fluid through the auxiliary outlets 70 to create the auxiliary jet portions 72, the auxiliary jet portions 72 being released in the low pressure zones 68, the auxiliary jet portions 72 having a velocity, a configuration, dimensions and a flow rate such that forces exerted on the main jet portions by the low pressure zones 68 are reduced by the auxiliary jet portions 72 so as to reduce turbulence in the main jet portions 66.

In some embodiments of the invention, the jet of fluid 48 is supersonic at the main outlets 64. Joining supersonic jet portions 66, as made possible by the invention, is completely unexpected in the art and is provided by the synergistic effects provided by the shapes of the blades 80 and the auxiliary outlet passageways 84 that extend therethrough.

Returning to FIG. 1, In some embodiments of the invention, a plurality of substantially elongated fins 110 extend in a substantially parallel relationship relatively to each other in the intermediate chamber 26. The fins 110 extend in the casing 18 outside of the proximal chamber 24 substantially in register with the proximal-to-intermediate chamber transfer aperture 56. More specifically, the fins 110 are located in a substantially horizontally spaced apart relationship relative to the proximal-to-intermediate chamber transfer aperture 56. The fins 110 are provided for substantially removing all residual velocity of the jet of fluid 48 when the jet of fluid 48 reach the distalmost end of the intermediate chamber 26. To that effect, the fins 110 are provided substantially adjacent to the intermediate-to-distal wall 38.

Figure 11:
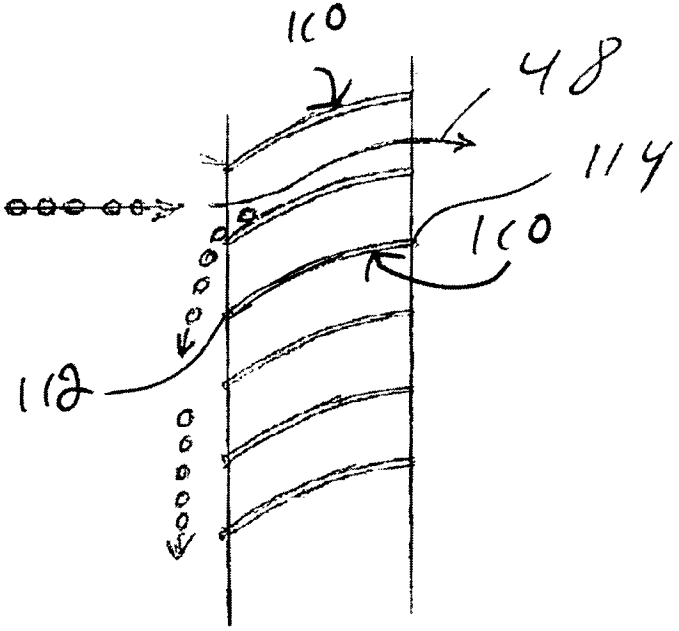
FIG. 11, in a schematic cross-sectional view, illustrates fins part of the propulsive element shown in FIG. 3.
Figure 12:
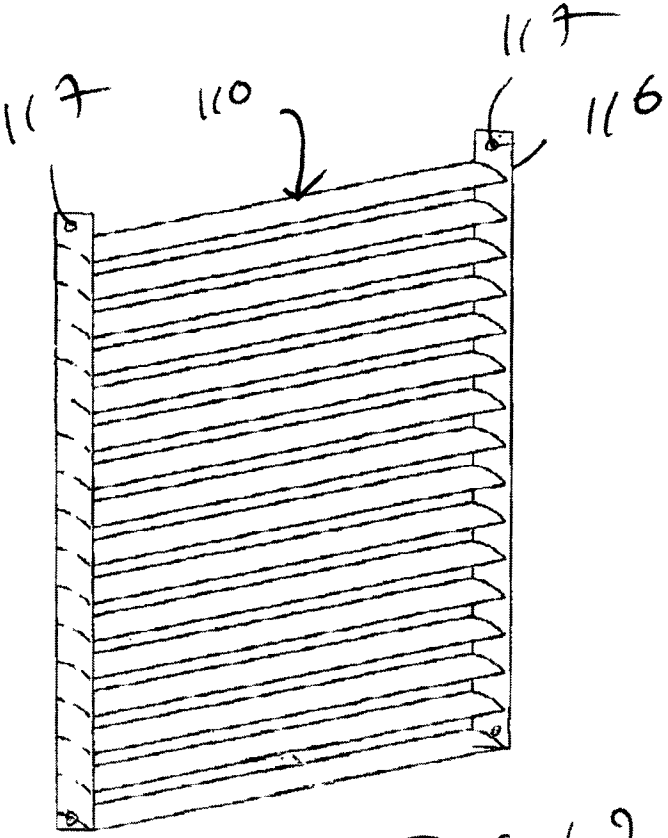
FIG. 12, in a perspective view, illustrates the fins shown in FIG. 11.

Each of the fins 110 has a substantially arcuate transversal cross-sectional configuration. As better seen in FIG. 11. Each of the fins 110 defines a fin proximal side edge 112 and a substantially laterally opposed fin distal side edge 114, the fin distal side edge 114 being located further away from the proximal chamber 24 than the fin proximal side edge 112. The fin proximal side edge 112 is lower than the fin distal side edge 114. In some embodiments of the invention, the fins 110 are mounted on a frame 116 defining mounting apertures 117 for mounting the frame 116 to the casing 18, as seen in FIG. 12. The fins 110 are therefore in a predetermined relationship with respect to each other. In other embodiments of the invention, the spacing, and/or, the angle of the fins 110 is selectively adjustable. The frame 116 is typically removal by mountable inside the casing 18 so that fins 110 have various shapes, dimensions, orientations and fin-to-fin spacing can be mounted in the casing 18. The fins 110 are selected according to the characteristics of the jet of fluid 48 produced and of the non-consolidated material 14 to process.

Figure 30:
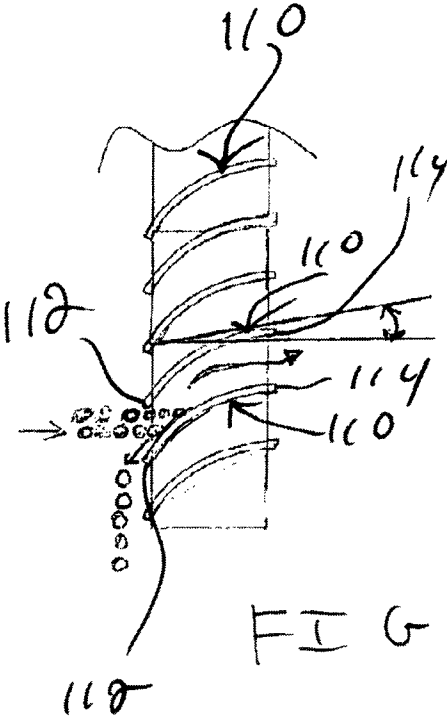
FIG. 30, in a side cross-sectional view, illustrates fins part of the apparatus shown in FIGS. 1 and 2.

In some embodiments of the invention, the fin proximal side edge 112 of each fin 110 is located at a level lower than the fin distal side edge 114 of the fin 110 above which it is located, as seen in FIG. 30. In addition to dividing and slowing down the jet of fluid 48 in the intermediate chamber 26, this configurations collects and agglomerates micronetic fine particles that have stayed in suspension in the fluid and redirects them in the intermediate chamber 26 for decantation.

As seen for example in FIG. 2, the apparatus 10 also includes a selector 118 provided in the intermediate chamber 26 below the proximal-to-intermediate chamber transfer aperture 56. The selector 118 is operative for returning to the proximal chamber 24 material transferred in the intermediate chamber 26 that is closer than a predetermined distance 120 from the proximal-to-intermediate wall 36. Typically, the selector 118 is configured and sized such that the predetermined distance 120 is selectively adjustable.

Figures 13, 13A, 14:
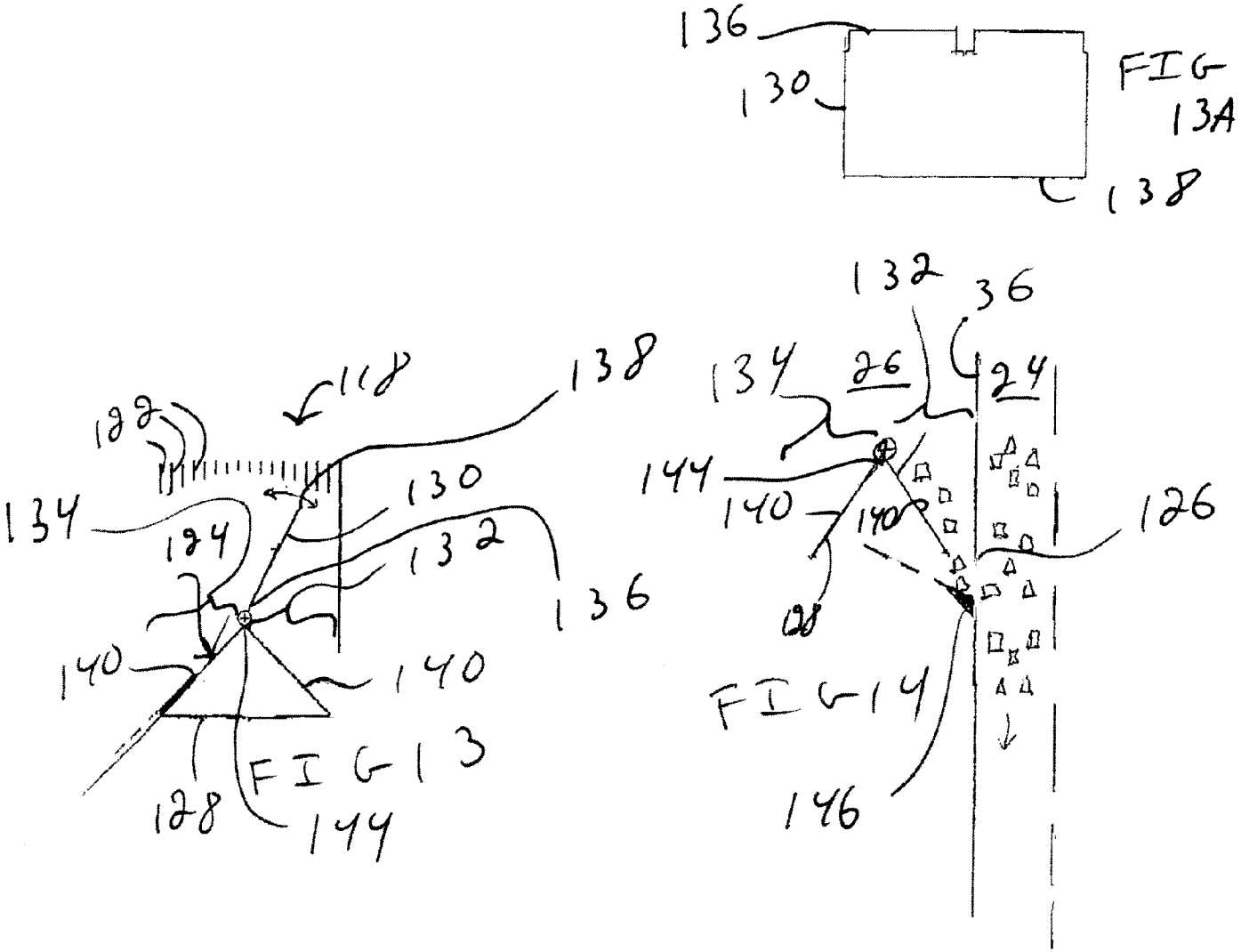
FIG. 13, in a schematic cross-sectional view, illustrates a selector part of the propulsive element shown in FIG. 3.
FIG. 13A, in front elevation view, illustrates a selector part of the propulsive element shown in FIG. 3.
FIG. 14, in a schematic cross-sectional view with parts removed, illustrates the selector shown in FIG. 13.

Referring to FIG. 13, the selector 118 defines a plurality of substantially vertically extending selecting passageways 122 disposed in a substantially parallel and adjacent relationship relatively to each other. The selecting passageways 122 are located at different distances from the proximal-to-intermediate wall 36 (not seen in FIG. 13). The selector 118 includes a selecting element 124 for directing the material falling into the selecting passageways 122 that are closer than the predetermined distance 120 from the proximal-to-intermediate wall 36 toward the proximal-to-intermediate wall 36. As seen in FIG. 14, the proximal-to-intermediate wall 36 defines a collecting aperture 126 extending therethrough for allowing transfer in the proximal chamber 24 of the material falling into the selecting passageways 122 that is closer than the predetermined distance 120 from the proximal-to-intermediate wall 36.

The selecting element 124 includes a selecting element body 128 and a collector 130. The selecting element body 128 defines a selecting body proximal portion 132 and a selecting body distal portion 134, the selecting body proximal portion 132 being located closer to the proximal-to-intermediate wall 36 than the selecting body distal portion 134. The collector 130 defines a collector bottom end 136 and a substantially opposed collector top end 138. The collector 130 is pivotally mounted to the selecting element body 128 between the selecting body proximal and distal portions 132 and 134 substantially adjacent the collector bottom end 136 so that the collector top end 138 is movable across the selecting passageways 122.

Typically, the selecting body proximal and distal portions 132 and 134 each define a substantially planar surface 140, 142, the substantially planar surfaces 140, 142 merging at an apex 144. The collector 130 is pivotally mounted to the selecting element body 128 substantially adjacent the apex 144.

In some embodiments of the invention, the collector 130 is substantially planar and provides a guide for guiding materials falling in the selecting passageways 122 that are closer than the predetermined distance 120 from the proximal-to-intermediate wall 36 toward the selecting body proximal portion 132, after which this material slides on the selecting body proximal portion 132 toward the proximal-to-intermediate wall 36. In some cases, as seen in FIG. 14, a chute 146 is extending from the proximal-to-intermediate wall 36 and protruding in the intermediate chamber 26, the chute 146 being below the proximal edge of the selecting body proximal portion 132 and leading to the collecting aperture 126. In other cases, as seen in the bottom selector of FIG. 1, the chute 146 is omitted and the material reaching the proximal edge of the selecting body proximal portion 132 falls freely though the remainder of the intermediate chamber 26.

Figure 15:
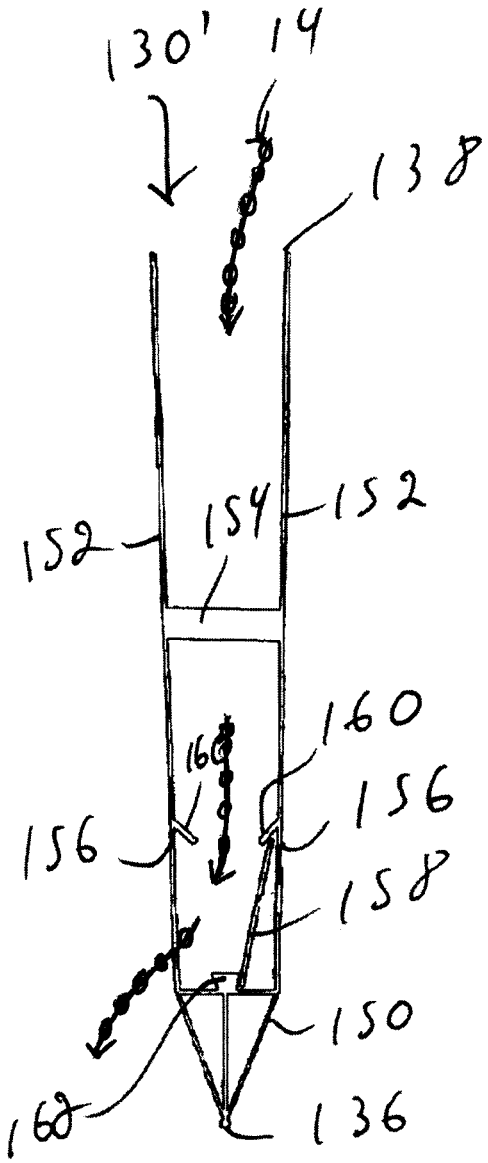
FIG. 15, in a schematic cross-sectional view, illustrates a selecting element part of the selector shown in FIGS. 13 and 14.
Figure 16:
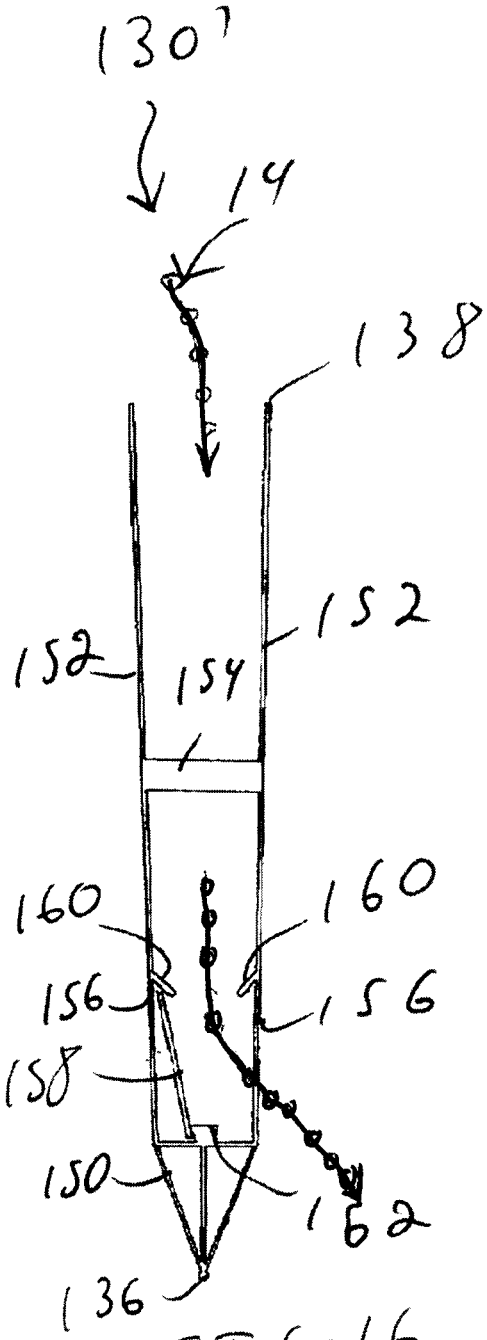
FIG. 16, in a schematic cross-sectional view, illustrates the selecting element shown in FIG. 15.

In some embodiments of the invention, the collector 130 is replaced by the collector 130' seen in FIGS. 15 and 16. The collector 130' includes a collector base 150 and a pair of collector walls 152 extending substantially upwardly therefrom in a substantially parallel relationship relatively to each other, although angled relationships are also possible. A reinforcing member 154 extends between the collector walls 152 in a spaced apart relationship with the collector base 150. Each collector walls 152 typically defines a discharge aperture 156 for discharging material falling in between the collector walls 152. The discharge apertures 156 are selectively obstructable, for example using a removable panel 158 extending thereacross. To that effect, a panel retaining flange 160 extends substantially downwardly and diagonally from each collector wall 152 and a panel retaining flange 162 extends substantially upwardly from the collector base 150 between the collector walls 152. The removable panels 158 are positionable so as to abut against the panel retaining flanges 160 and 162 and thereby obstruct one of both of the discharge aperture 156. Selectively obstructing the discharge apertures 156 allows fine-tuning of the type of particles selected by the selector 118.

Figure 18:
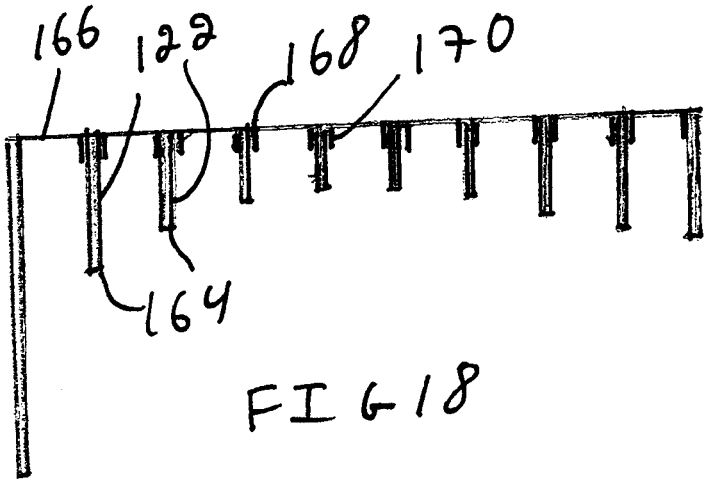
FIG. 18, in a schematic cross-sectional view with parts removed, illustrates the selector shown in FIG. 13.
Figure 17:
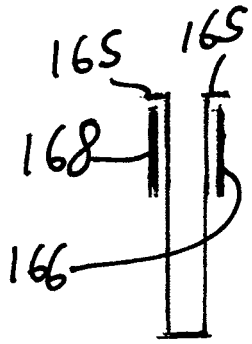
FIG. 17, in a schematic cross-sectional view with parts removed, illustrates the selector shown in FIG. 13.

A seen in FIG. 18, the selecting passageways 122 are defined by wall sections 164 mounted in a frame 166 defining a plurality of substantially parallel mounting apertures 168, the mounting apertures 168 alternating with material receiving apertures 170 each leading to and located above a respective one of the selecting passageways 122 and usable for receiving the material falling therethrough and leading this material into the selecting passageways 122. As seen in FIG.

17, each wall section 154 is substantially planar and defines a pair of mounting flange 165 resting on the frame 166, the remainder of the wall section 164 extending through and below the mounting aperture 168. The wall sections 164 have a length such that the selecting element remains substantially adjacent to the lower end of each wall section 164 when moved across the selecting passageways 122.

Figure 19:
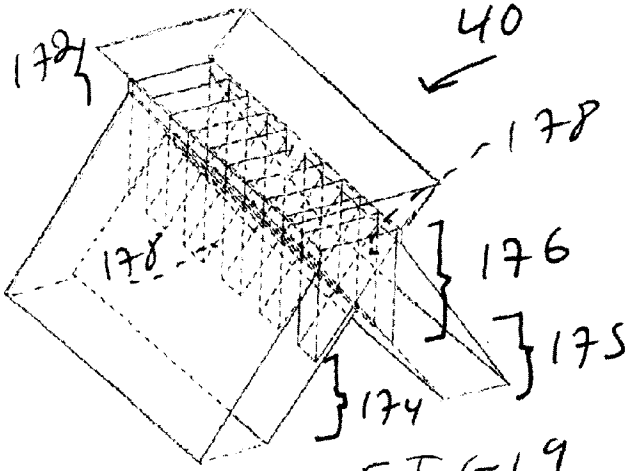
FIG. 19, in a perspective view, illustrates a distributor part of the apparatus shown in FIGS. 1 and 2.
Figure 20:
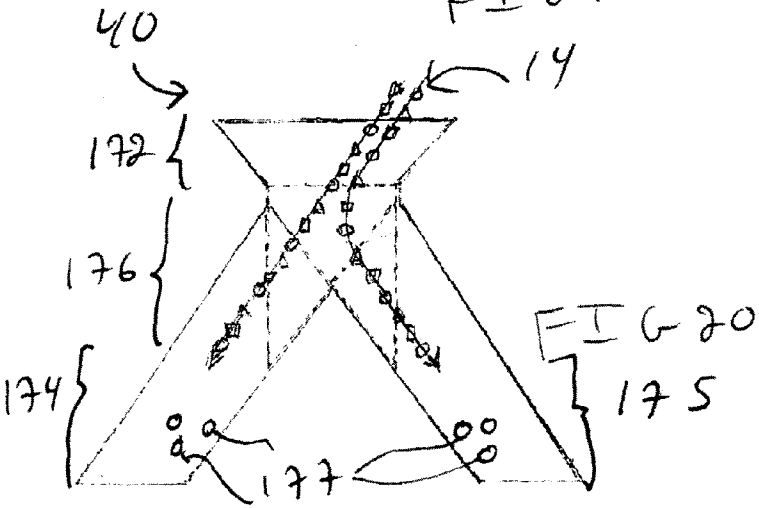
FIG. 20, in a side elevation view, illustrates the distributor shown in FIG. 19.

With reference to FIGS. 19 and 20, the distributor 40 includes a distributor inlet section 172, a distributor first and a second outlet sections 174 and 175 and a distributor intermediate section 176 extending therebetween. The distributor inlet section 172 tapers in a direction leading towards the distributor intermediate section 176. The distributor inlet section 172 therefore forms a funnel for receiving the material 14 and leading the material 14 toward the distributor intermediate section 176. The distributor first and a second outlet sections 174 and 175 each lead to a respective one of the casing inlets 20, as seen in FIG. 1. In some embodiments of the invention, substantially elongated deflecting rods 177 (seen only in FIG. 20) are removably insertable across the distributor first and a second outlet sections 174 and 175 for facilitating spreading of the non-consolidated material 14 across the horizontal cross-section of the casing inlet 20.

Figure 21:
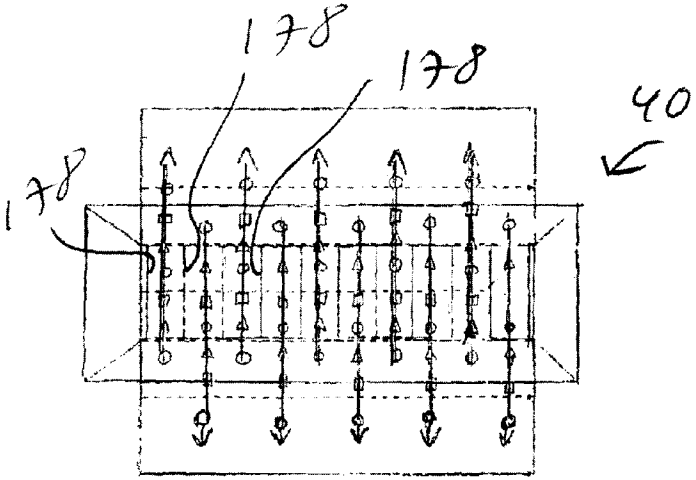
FIG. 21, in a top plan view, illustrates the distributor shown in FIGS. 19 and 20.

As seen in FIGS. 19 and 21, the distributor intermediate section 176 defines a plurality of distributor passageways 178 extending between the distributor inlet section 172 and the distributor first and a second outlet sections 174 and 175. A first subset of the distributor passageways 178 extend between the distributor inlet section 172 and the distributor first outlet section 174. A second subset of the distributor passageways 178 extend between the distributor inlet section 172 and the distributor second outlet section 175. The distributor passageways 178 extend in a substantially parallel relationship relative to each other, the distributor passageways from the first and second subsets alternating with each other. The distributor passageways 178 are typically substantially diagonally oriented relatively to the vertical. This configuration is similar to that of a riffle splitter.

Figure 22:
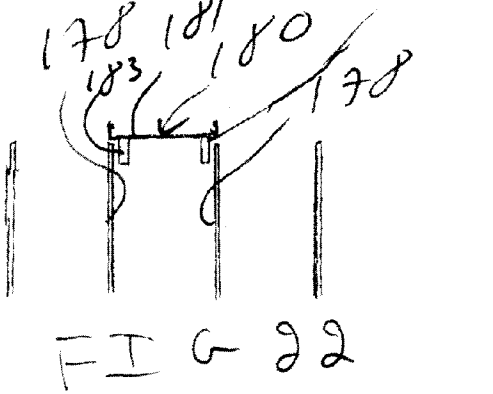
FIG. 22, in a side cross-sectional view, illustrates a lid usable with the distributor shown in FIGS. 19 to 21.
Figure 28:
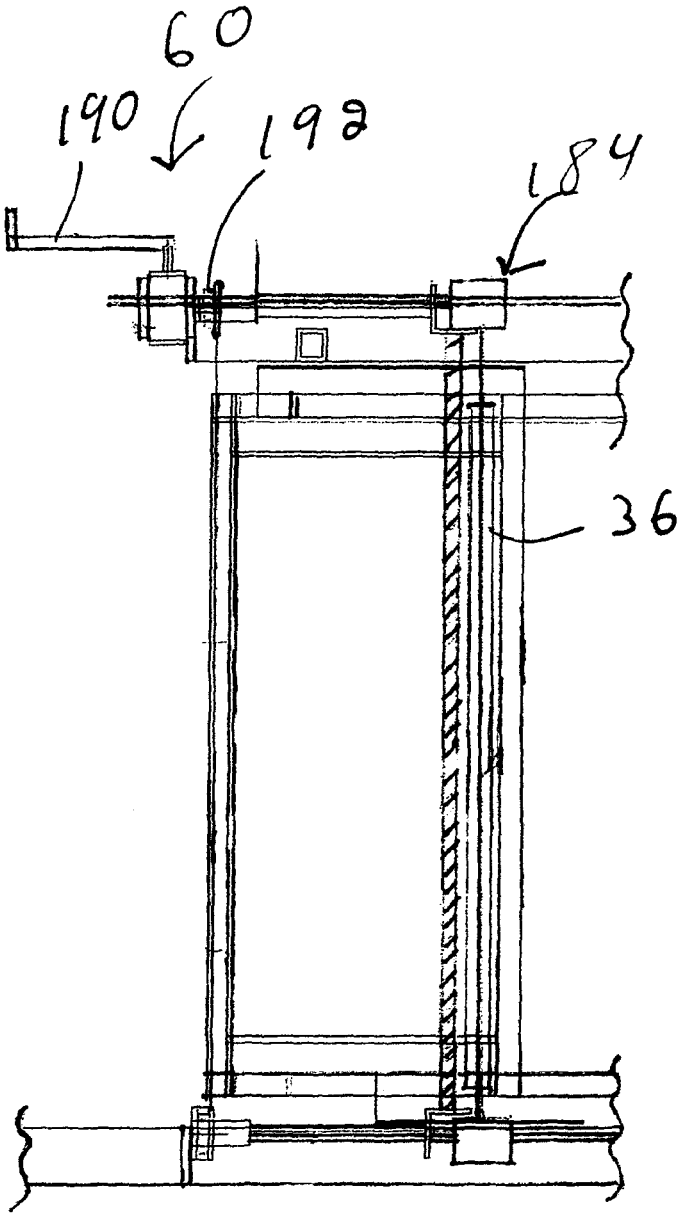
FIG. 28, in a top plan schematic view, illustrates the actuator shown in FIG. 27.

In some embodiments of the invention, lids 180 are provided for selectively obstructing one or more of the distributor passageways 178, as seen in FIG. 22. Each lid 180 includes a lid body 181 positionable across one of the distributor passageways 178, for example at the top end thereof. Flanges 183 extend substantially perpendicularly from the lid body 181 and engage the periphery of the distributor passageways 178 to secure the lids 180 in place The movements of the proximal-to-intermediate wall 36 are now described in further details with respect to FIG. 27, FIG. 28 illustrating also some details of the same aspect of the invention. A pair of rails 182 extend along the interior of the casing 18 substantially adjacent the top end thereof, substantially horizontally and substantially perpendicularly to the proximal-to-intermediate wall 36. The actuator 60 includes a carriage 184 movable along the rails 182. The carriage 184 includes a carriage body 186 and wheels 188 rotatably mounted to the carriage body 186. The wheels 188 are rollable along the rails 182. The proximal-to-intermediate wall 36 is suspended to the carriage body 186. In some embodiments, the wheels 188 rolling on the two rails 182 are coupled to each other using a shaft to ensure substantially similar displacements of the carriage 184 on both rails 182.

The actuator 60 also includes a handle 190 pivotally mounted outside of the casing 18. The handle 190 is mechanically coupled to a system of gears 192, the system of gears being operatively coupled to the handle 190 and to the wheels 188 such that rotation of handle 190 relatively to the casing 18 results in rotation of the wheels 188 relatively to the rails 182, for example using gears, and shafts in a conventional manner.

In some embodiments of the invention, a substantially similar actuator 60, acting independently from the actuator described hereinabove, and rails 182 are provided also substantially adjacent the bottom of the casing 18. In these embodiments, the proximal-to-intermediate wall 36 is also supported by this other actuator 60 that includes an alternative carriage 184' having an alternative carriage body 186' that are typically less robust than the carriage 184 and carriage body 186.

Figure 25:
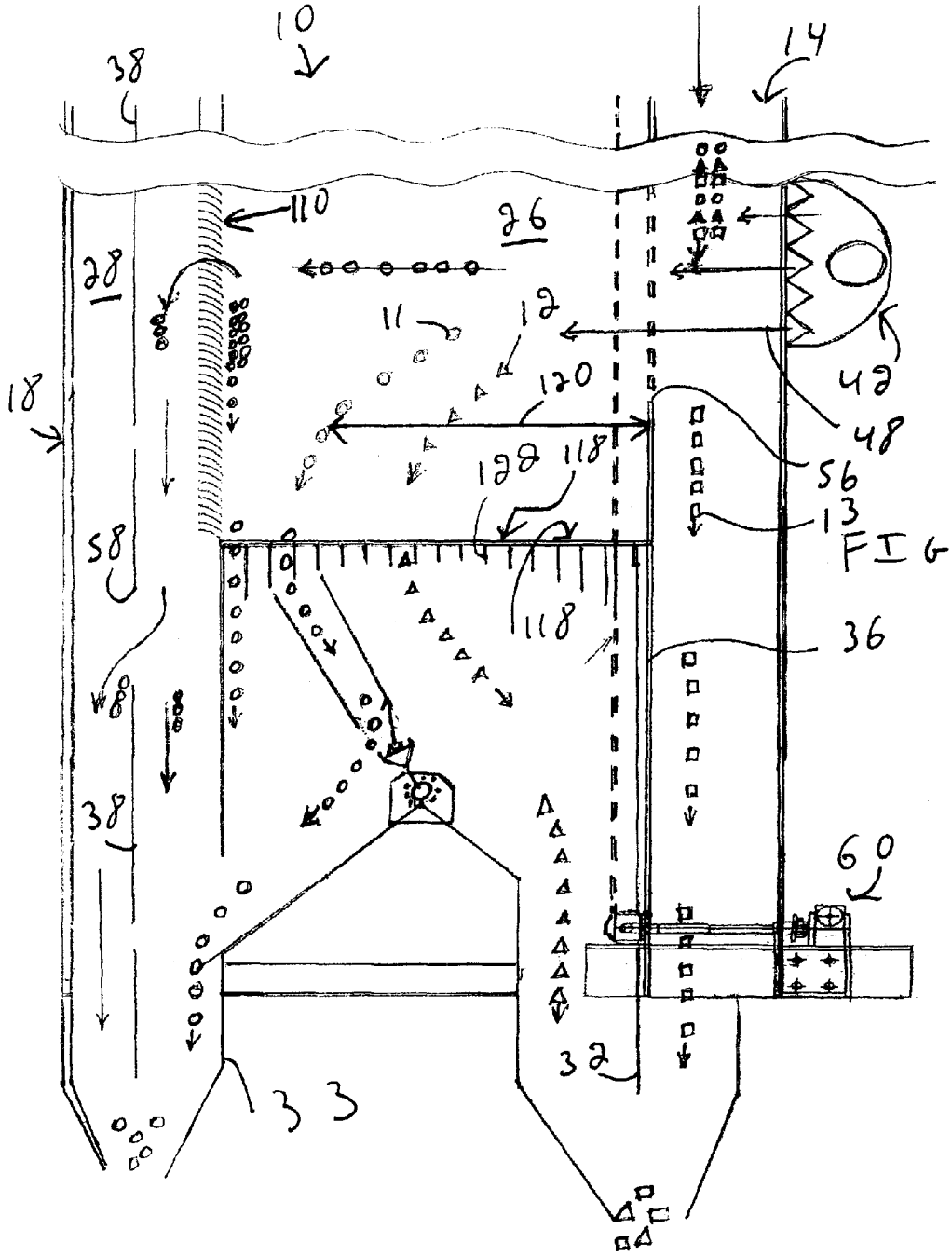
FIG. 25, in a side schematic cross-sectional view, illustrates a separation process performed by the apparatus shown in FIGS. 1 and 2.
Figure 26:
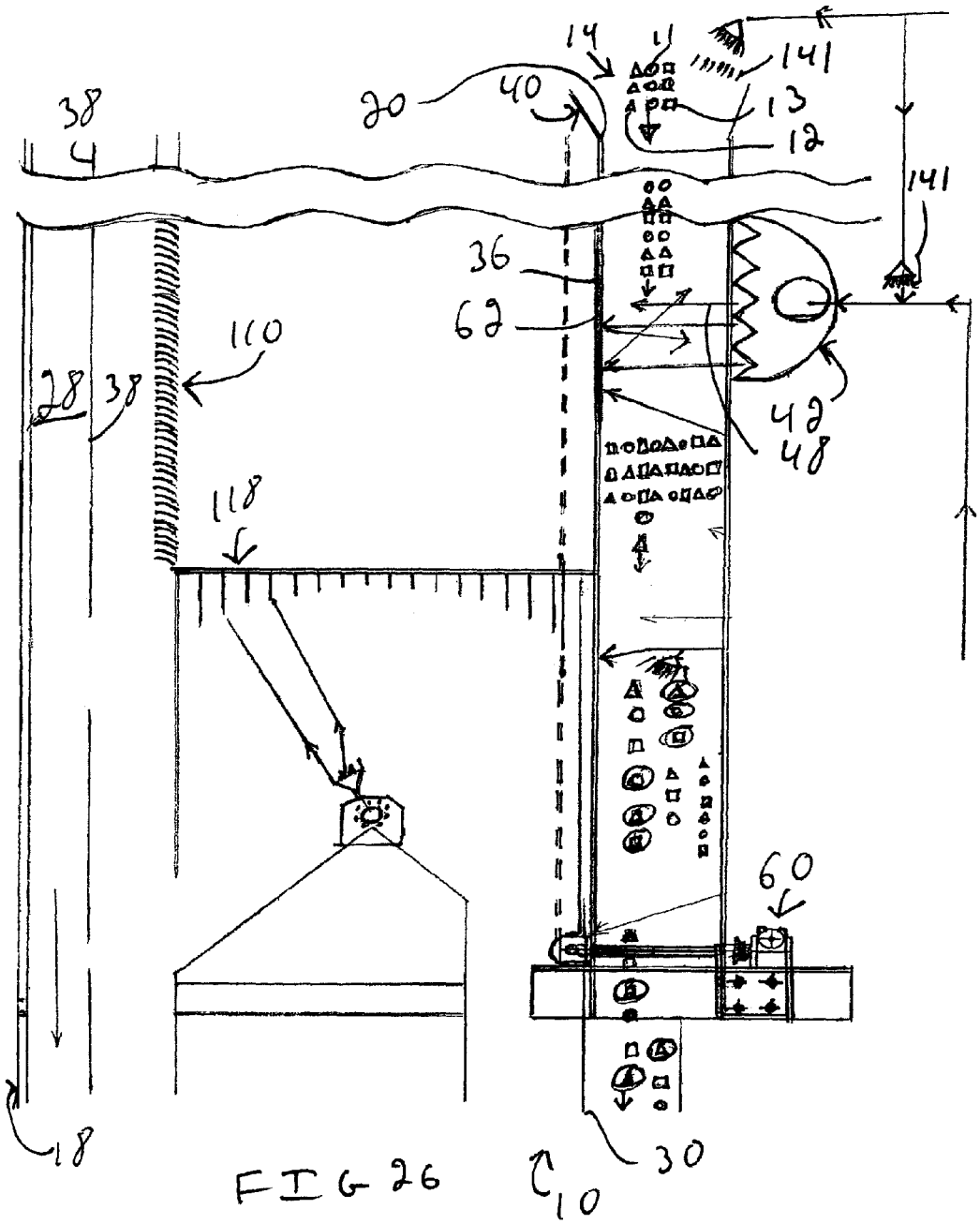
FIG. 26, in a side schematic cross-sectional view, illustrates a mixing and treatment process performed by the apparatus shown in FIGS. 1 and 2.

FIGS. 25 and 26 illustrate two different possible uses for the apparatus 10. In FIG. 25, the apparatus 10 is usable for mixing and separating constituent particles having different properties in a granular material 14. In FIG. 26, the apparatus 10 is used for mixing together the various constituent particles of a granular material 14 and treating them. To that effect, a treatment fluid 41, or particulate matter, is injected along with compressed air in the propulsive elements 42 or in any other suitable manner in the proximal chamber 24.

Referring to FIG. 26, a granular material 14 is led by the distributor 40 in freefall through the casing inlet 20 (not seen in FIG. 26, but substantially similar to what is seen in FIG. 25). This granular material 14 is accelerated under the action of gravity after having been projected on the transversal cross-sectional area of the chamber, these two actions together producing a reduction in concentration of the original substantially compact material provided at the casing inlet 20, also called dilution or "deconcentration" of the granular material 14. When the granular material 14 reaches the uppermost propulsive element 42, the jet of fluid 48 impacts the various particles forming the granular material 14 and project them with great force on the planar surface 61 (not seen in FIG. 26, but substantially similar to what is seen in FIG. 25). This mixes efficiently the granular material 14, which continues its freefall into the proximal chamber 24 until it reaches the proximal chamber outlet 30. In this configuration, the proximal-to-intermediate chamber transfer aperture 56 is not used and is typically blocked by the panel 62. In embodiments of the invention in which the granular material 14 freefalls in front of many successive propulsive elements 42, the mixing effect would be enhanced.

As seen in FIG. 25, in other embodiments of the invention, the proximal-to-intermediate chamber transfer aperture 56 is not blocked. However, the uppermost propulsive elements 42 is still used for mixing the granular material 14. After this mixing step, the granular material 14 continues its freefall until it reaches another one of the propulsive elements 42 that is substantially in register with a proximal-to-intermediate chamber transfer aperture 56 and located a predetermined distance from the uppermost propulsive element 42. The particles of the first, second, and third types of constituent particles 11, 12, 13 have different aerodynamic and inertial properties and therefore react differently to force is exerted thereunto by the jet of fluid 48 projected by the propulsive elements 42. The particle of the second type 12, represented by triangles, are projected through the proximal-to-intermediate chamber transfer aperture 56. The particles of the first type 11, represented by circles, are also projected through the proximal-to-intermediate chamber transfer aperture 56, but they are projected over a larger distance. Finally, particles of the third type 13, represented by squares, remain in the proximal chamber 24.

The interaction between the non-consolidated material 14 and the jet of fluid 48 is typically qualitatively different than typical fluid/matter interaction in prior art devices. Indeed, the jet of fluid 48 has properties such that the non-consolidated material 14 is impacted with a great force, and not simply entrained through surface drag. Momentum is transferred very rapidly from the jet of fluid 48 to the non-consolidated material 14. The impact forces on the non-consolidated material 14 change the movement direction of the constituent particles of the non-consolidated material 14 to be treated, which are therefore not simply falling but also have a significant horizontal movement component.

The selector 118 is configured such that the predetermined distance 120 corresponds to a distance within which it is expected that particle of the second type 12 will fall through the selecting passageways 122. These particles of the second type 12 are returned toward the proximal chamber outlet 24. In embodiments of the invention in which many stages are provided, these particles of the second type 12 can be returned in the proximal chamber 24 for further processing. The particles of the first type 11 are directed the toward the intermediate chamber outlet 33 by the selector 118.

Fine particles, represented the by the rounded particles located substantially adjacent to the fins 110 are deposited onto the fins 110, at which point they are agglomerated and fall back into the intermediate chamber 26 toward the selector 118.

Therefore, the apparatus 10 is usable to perform a method in which a stream of non-consolidated material in provided in free fall, and in which at least a portion of the stream of non-consolidated material 14 is projected substantially horizontally by directing the jet of fluid 48 on the vertically falling stream of non-consolidated material 14. Prior to that step, of projecting, the stream of non-consolidated material 14 is distributed substantially uniformly over the transversal cross-sectional area of the proximal chamber substantially adjacent the top end thereof.

In different variants, particles are processed by various numbers of propulsive elements 42 and are redirected by selectors 118 toward the proximal chambers 24 and into the intermediate chamber 26 in any suitable manner, depending on the process to perform.

In some embodiments of the invention, processing of the pressurized fluid 17 results in an increase in temperature of this fluid, which may be advantages for many applications. Also, by injecting suitable substances, such as the treatment fluid 41, which can be a liquid, through the propulsive elements 42, or in any other suitable manner, physico-chemical processing of the non-consolidated material 14 is possible.

In some embodiments of the invention, the jet of fluid 48 has a jet flow rate, jet dimensions and a jet velocity able to change the direction of movement of vertically falling material to move substantially horizontally over a predetermined distance the non-consolidated mineral materials 14 having a material density of at least 1 ton per cubic meter and a granular falling rate of at least 100 tons per hour.

In some embodiments, the apparatus 10 operates as a mass deconcentrator configured and sized for diluting the original mass of non-consolidated material 14 by at least 50 times when the non-consolidated material 14 falls through the proximal chamber 24 and for accelerating the non-consolidated material 14 to increase its falling speed by a factor of at least 10, for example up to a speed of about 10 m/s. Accelerating the non-consolidated material 14 synergetically interacting with the transversal cross-sectional area of the proximal chamber 24 reduces a concentration of the non-consolidated material 14 by a factor suitable for creating sufficient free space around constituent particles of the non-consolidated material 14 so that some or all of these constituent particles can be projected in the small amount of time during which the particles go by the propulsive elements 42.

In one example, the apparatus 10 is usable for removing fine particles, for example particles having a diameter smaller than 80μ, into crushed stone having dimensions less than 25 millimeters. This task is conventionally impossible to perform at this rate in a dry process. The large dilution factor provided by the proposed apparatus 10 facilitates the treatment of these particles at large rates, for example at more than 240 tons per hour. Surprisingly, all these treatments occur in a relatively short amount of time, which is the time over which the stone falls in front of the propulsive elements 42 in free-fall, which is typically less than 1/10 second. All these operations occur in a proximal chamber 24 having 1 m×30 cm in dimensions. It is hypothesized that the proposed apparatus completely separates all the particles contained in the non-consolidated material 14 from each other. Therefore, the jet of fluid 48 can act on each of these particles and efficiently separate, treat, or mix them.

Figures 23, 24:
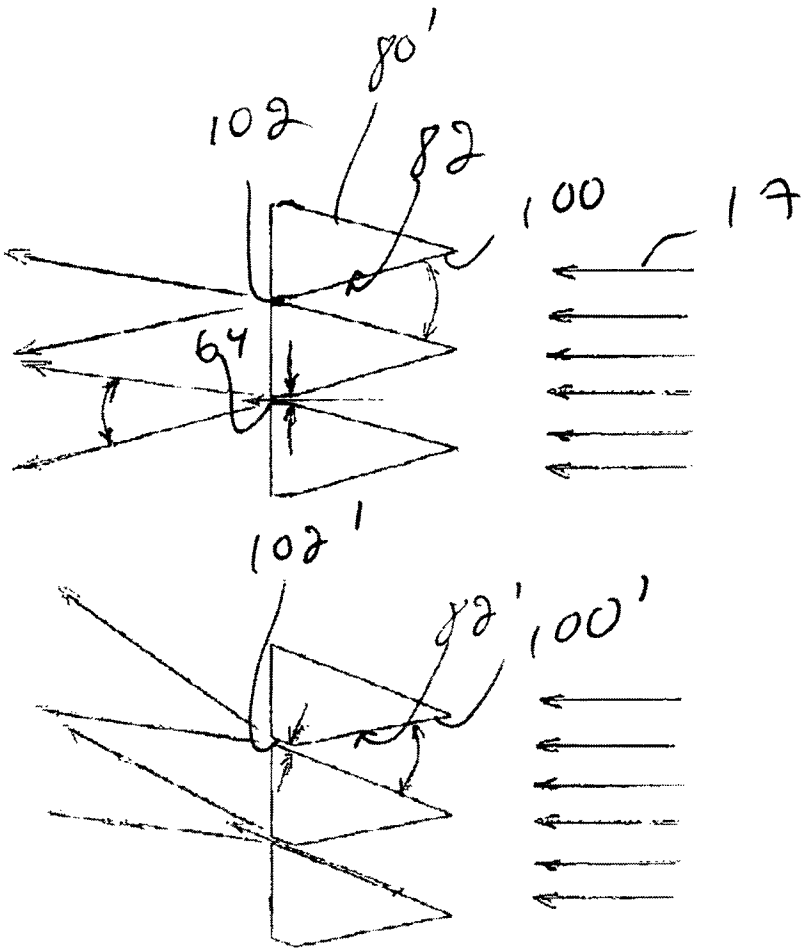
FIG. 23, in a side cross-sectional schematic view, illustrates the blades shown in FIGS. 6 and 7.
FIG. 24, in a side cross-sectional schematic view, illustrates alternative blades usable with the propulsive element shown in FIG. 3.

Many variants and specific embodiments of the invention are possible. For example, as seen in FIG. 23, the blades 80 shown in the above described figures define main passageways 82 having a substantially symmetrical configuration about the horizontal. However, in alternative embodiments of the invention, they are configured such that the rectilinear section 102 is angled with respect to the horizontal. For example, the rectilinear section 102 is angled upwardly in a direction leading towards the main outlets 64. In a specific embodiment of the invention, it was found at an angle of about 30° with the horizontal provides good results, but other values are within the scope of the present invention.

In some embodiments of the invention, the tapered section 104 tapers with an angle of about 30° with respect to the horizontal. Also, spacing elements 86 of different thicknesses, for example and non-limitingly, between 0.2 and 1 mm, are provided. This creates main jet portions 66 that join with each other over a relatively small distance, for example less than 15 mm. For example, the auxiliary outlet passageways 84 are configured so that the velocity of the compressed fluid 17 passing therethrough decreases by a factor of about 10. In some embodiments of the invention, seven main jet portions are provided in each propulsive elements 42.

Many variants for the propulsive elements 42 have been tested. It was found that increasing the pressure of the pressurized fluid 17 produces a jet of fluid 48 that increases in speed over two substantially linear ranges, one below about 100 m/s and the other one above about 200-250 m/s (with 7 blades spaced apart by about 0.5-1 mm). In all cases, the speed of the jet of fluid 48 decreases relatively rapidly at first as distance from the propulsive element 42 increases over of range of for example less than 150-300 mm, to stabilize afterwards and decrease much slower.

All the above suggests a method for processing a stream of non-consolidated material 14 in an apparatus, such as, for example, the apparatus 10 described hereinabove. The apparatus 10 including a substantially vertical proximal chamber 24 delimited by a proximal chamber peripheral wall, formed on three sides by the casing 18 and on the other side by the proximal-to-intermediate wall 36. The method includes distributing substantially uniformly the stream of non-consolidated material 14 over an horizontal cross-sectional area of the proximal chamber 24. This is performed in the apparatus 10 by the distributor 40. The method also includes mixing substantially homogeneously the stream of non-consolidated material 14 in the proximal chamber 24.

In some embodiments of the invention, this mixing is performed by propulsing the stream of non-consolidated material 14 substantially horizontally in the proximal chamber 24 by directing a jet of fluid 48 on the stream of non-consolidated material 14, which causes the stream of non-consolidated material 14 to be mixed by bouncing on the proximal chamber peripheral wall, as described in details hereinabove.

In some embodiments, the method is used to treat the stream of non-consolidated material 14. For example, this is performed by, after mixing substantially homogeneously the stream of non-consolidated material 14, letting the stream of non-consolidated material 14 freefall over a predetermined falling distance, introducing in the proximal chamber 24 a treatment fluid 41, and treating the stream of non-consolidated material 14 with the treatment fluid 41 by directing another jet of fluid 48 on the stream of non-consolidated material 14 and on the treatment fluid 48. The stream of non-consolidated material 14 is mixed and treated by the treatment fluid 48 by bouncing on the proximal chamber peripheral wall. In some embodiments of the invention, the treatment fluid 41 is introduced substantially jointly with the other jet of fluid 48, for example through a propulsive element 42.

In the apparatus 10, a substantially vertical intermediate chamber 26 extends in a substantially parallel and adjacent relationship relatively to the proximal chamber 24. The method may then include, additionally or instead of the treatment step described in the previous paragraphs, after mixing substantially homogeneously the stream of non-consolidated material 14 in the proximal chamber 14, letting the stream of non-consolidated material 14 freefall over a predetermined falling distance to distance constituent particles of the stream of non-consolidated material 14, and after the freefall over the predetermined falling distance, propulsing at least a portion of the stream of non-consolidated material 14 substantially horizontally by directing another jet of fluid 48, for example produced by a propulsive element 42, as described hereinabove, on the stream of non-consolidated material 14 to transfer the at least a portion of the stream of non-consolidated material to the intermediate chamber 26, thereby separating the at least a portion of the stream of non-consolidated material 14 from the remainder of the stream of non-consolidated material 14.

In some embodiments of the invention, the method includes selecting in the intermediate chamber 26 a subset of constituent particles from the at least a portion of the stream of non-consolidated material 14 that have traveled in said intermediate chamber 26 by a distance smaller than the predetermined distance 120 and returning the subset of constituent particles to the proximal chamber 24.

In some embodiments of the invention, the method includes slowing down the jet of fluid 48 in the intermediate chamber 26, for example using the fins 110 as described hereinabove. The method may also include decanting constituent particles of the stream of non-consolidated material 14 remaining in suspension in the jet of fluid 48 in the intermediate chamber 26. The method may also include agglomerating constituent particles of the stream of non-consolidated material 14 remaining in suspension in the jet of fluid 48 in the intermediate chamber 26.

In some embodiments of the invention, the method also includes selecting in the intermediate chamber 26 a subset of constituent particles from the at least a portion of the stream of non-consolidated material 14 that have traveled in the intermediate chamber 26 by a distance larger than the predetermined distance 120 and recovering the subset of constituent particles, for example at the intermediate chamber outlet 33.

More generally speaking, the above suggest a method for separating a particle stream, for example the stream of non-consolidated material 14, into particle groups. This method includes vertically diluting the particle stream by directing the particle stream into a falling condition within a chamber, such as the proximal chamber 24, and accelerating the particle stream under the action of gravity, subsequently horizontally diluting the particle stream by distributing the particle stream by subjecting the particle stream to a jet of fluid 48 creating lateral forces so as to distribute the particle stream over a surface area of the chamber with the particle stream remaining confined inside the chamber, afterwards projecting a particle group away from a remainder of the particle stream and outside of the chamber by creating a fluid flow of predetermined magnitude across the particle stream in the falling condition, and collecting the particle group and the remainder of the particle stream at separate locations. This is made possible by the different fluid dynamic and inertial properties of the different constituent particles forming the particle stream. More specifically, the particle stream includes at least two types of particles, one of which is projected outside of the particle stream by the jet of fluid 48.

Typically, this includes substantially horizontally diluting the particle stream by providing a horizontal velocity to the particle stream prior to vertically diluting the particle stream. At least a portion of this distribution of the particle stream includes injecting a fluid flow, such as the jet of fluid 48, into the particle stream to distribute the particle stream over the horizontal surface area of the chamber.

Typically, collecting the particle group and the remainder of the particle stream at separate locations includes collecting the particle group into at least two particle subgroups by providing a first collecting location for collecting the separated particle groups (such as the intermediate chamber outlets 32 and 33), and a second collecting location (such as the proximal chamber outlet 34) for collecting the remaining particle stream in the chamber (here the proximal chamber 24), so as to collect particles in the subgroups according to the predetermined magnitude influencing the quantity and traveling distance of entrainment and projection of the particles, caused by the different fluid dynamic and inertial properties of the different constituent particles forming the particle stream. In other words, having particles that react differently to the jet of fluid 48 creates separation of particles by moving selected particles with the jet of fluid 48 over predetermined distances.

Although the present invention has been described hereinabove by way of preferred embodiments thereof, it can be modified, without departing from the spirit and nature of the subject invention as defined in the appended claims.

What is claimed is:

1. An apparatus for processing a stream of non-consolidated material, said apparatus being usable with a source of pressurized fluid, said apparatus comprising:

a substantially upstanding casing, said casing defining a casing inlet, a casing outlet and a proximal chamber extending therebetween, said casing inlet being located above said casing outlet;

a distributor located above said casing inlet for receiving said stream of non-consolidated material and distributing said stream of non-consolidated material substantially uniformly over said casing inlet; and a propulsive element, said propulsive element defining a propulsive element inlet couplable in fluid communication with said source of pressurized fluid for receiving said pressurized fluid, said propulsive element defining a propulsive element outlet for releasing a jet of fluid when said propulsive element inlet receives said pressurized fluid, said propulsive element being operatively coupled to said casing for releasing said jet of fluid in said proximal chamber;

wherein said casing defines a substantially vertically extending distal chamber substantially parallel to said proximal chamber, said apparatus further comprising a wall extending substantially vertically in said casing between said distal and proximal chambers, said wall being movable substantially horizontally in a translation movement in said casing and said apparatus further comprises an actuator for moving said wall substantially horizontally relative to said casing;

whereby moving said wall substantially horizontally in said casing changes horizontal cross-sectional areas of said proximal and distal chambers.

2. An apparatus as defined in claim 1, wherein said propulsive element is operatively coupled to said casing for releasing said jet of fluid in said proximal chamber substantially horizontally.

3. An apparatus as defined in claim 1, wherein said propulsive element is operatively coupled to said casing for releasing said jet of fluid in said proximal chamber substantially obliquely and upwardly with respect to the horizontal.

4. An apparatus as defined in claim 1, wherein said casing defines a propulsive element receiving aperture leading into said proximal chamber substantially opposed to said wall, said propulsive element outlet being substantially in register with said propulsive element receiving aperture.

5. An apparatus as defined in claim 4, wherein said propulsive element is an upper propulsive element, said propulsive element inlet is an upper propulsive element inlet, said propulsive element outlet is an upper propulsive element outlet and said jet of fluid is an upper jet of fluid, said apparatus further comprising a lower propulsive element defining a lower propulsive element inlet couplable in fluid communication with said source of pressurized fluid for receiving said pressurized fluid, said lower propulsive element comprising a lower propulsive element outlet for releasing a lower jet of fluid when said lower propulsive element inlet receives said pressurized fluid, said casing defining an upper and a lower propulsive element receiving aperture extending into said proximal chamber substantially opposed to said wall, said lower propulsive element receiving aperture being located below said upper propulsive element receiving aperture, said upper and lower propulsive element outlets being respectively substantially in register with said upper and lower propulsive element receiving apertures.

6. An apparatus as defined in claim 5, wherein said wall provides a substantially planar surface substantially horizontally opposed to said upper propulsive element receiving aperture.

7. An apparatus as defined in claim 5, wherein said wall defines a wall aperture extending therethrough substantially horizontally opposed to said lower propulsive element receiving aperture.

8. An apparatus as defined in claim 7, further comprising a panel removably attachable to said wall for selectively obstructing said wall aperture.

9. An apparatus for processing a stream of non-consolidated material, said apparatus being usable with a source of pressurized fluid, said apparatus comprising:

a substantially upstanding casing, said casing defining a casing inlet, a casing outlet and a proximal chamber extending therebetween, said casing inlet being located above said casing outlet;

a distributor located above said casing inlet for receiving said stream of non-consolidated material and distributing said stream of non-consolidated material substantially uniformly over said casing inlet; and a propulsive element defining a propulsive element inlet couplable in fluid communication with said source of pressurized fluid for receiving said pressurized fluid, said propulsive element defining a propulsive element outlet for releasing a jet of fluid when said propulsive element inlet receives said pressurized fluid, said propulsive element being operatively coupled to said casing for releasing said jet of fluid in said proximal chamber;

said casing defining a propulsive element receiving aperture extending into said proximal chamber substantially opposed to said wall, said propulsive element outlet being substantially in register with said propulsive element receiving aperture;

said casing also defining a substantially vertically extending distal chamber substantially parallel to said proximal chamber, said apparatus further comprising a wall extending substantially vertically in said casing between said distal and proximal chambers, said wall being movable substantially horizontally in said casing and said apparatus further comprises an actuator for moving said wall substantially horizontally relative to said casing, said wall defining a wall aperture extending therethrough substantially horizontally opposed to said propulsive element receiving aperture so that moving said wall substantially horizontally in said casing changes horizontal cross-sectional areas of said proximal and distal chambers;

said apparatus further comprising a plurality of substantially elongated fins extending in a substantially parallel relationship relatively to each other, said fins extending in said casing outside of said proximal chamber substantially in register with said wall aperture.

10. An apparatus as defined in claim 9, wherein said fins are located in a substantially horizontally spaced apart relationship relative to said wall aperture, each of said fins having a substantially arcuate transversal cross-sectional configuration.

11. An apparatus as defined in claim 10, wherein each of said fins defines a fin proximal side edge and a substantially laterally opposed fin distal side edge, said fin distal side edge being located further away from said wall aperture than said fin proximal side edge, said fin proximal side edge being lower than said fin distal side edge.

12. An apparatus for processing a stream of non-consolidated material, said apparatus being usable with a source of pressurized fluid, said apparatus comprising:

a substantially upstanding casing, said casing defining a casing inlet, a casing outlet and a proximal chamber extending therebetween, said casing inlet being located above said casing outlet;

a distributor located above said casing inlet for receiving said stream of non-consolidated material and distributing said stream of non-consolidated material substantially uniformly over said casing inlet; and a propulsive element defining a propulsive element inlet couplable in fluid communication with said source of pressurized fluid for receiving said pressurized fluid, said propulsive element defining a propulsive element outlet for releasing a jet of fluid when said propulsive element inlet receives said pressurized fluid, said propulsive element being operatively coupled to said casing for releasing said jet of fluid in said proximal chamber;

said casing defining a propulsive element receiving aperture extending into said proximal chamber substantially opposed to said wall, said propulsive element outlet being substantially in register with said propulsive element receiving aperture;

said casing also defining a substantially vertically extending distal chamber substantially parallel to said proximal chamber, said apparatus further comprising a wall extending substantially vertically in said casing between said distal and proximal chambers, said wall being movable substantially horizontally in said casing and said apparatus further comprises an actuator for moving said wall substantially horizontally relative to said casing, said wall defining a wall aperture extending therethrough substantially horizontally opposed to said propulsive element receiving aperture so that moving said wall substantially horizontally in said casing changes horizontal cross-sectional areas of said proximal and distal chambers;

said apparatus further comprising a selector provided in said distal chamber below said wall aperture, said selector being operative for returning to said proximal chamber component particles from said non-consolidated material transferred in said distal chamber that are closer than a predetermined distance from said wall, said selector being configured and sized such that said predetermined distance from said wall is selectively adjustable, said selector defining a plurality of substantially vertically extending selecting passageways disposed in a substantially parallel and adjacent relationship relatively to each other, said selecting passageways being located at different distances from said wall, said selector including a selecting element for directing said component particles falling into said selecting passageways that are closer than said predetermined distance from said wall toward said wall, said wall defining a collecting aperture extending therethrough for allowing transfer in said proximal chamber of said particles falling into said selecting passageways that are closer than said predetermined distance from said wall.

13. An apparatus as defined in claim 12, wherein said selecting element includes a selecting element body defining a selecting body proximal portion and a selecting body distal portion, said selecting body proximal portion being located closer to said wall than said selecting body distal portion;

and a collector defining a collector bottom end and a substantially opposed collector distal end, said collector being pivotally mounted to said selecting element between said selecting body proximal and distal portions substantially adjacent said collector bottom end, said collector top end being movable across said selecting passageways when pivoting relatively to said selecting element, said collector directing said component particles falling into said selecting passageways that are closer than said predetermined distance from said wall toward said wall and said collector directing said component particles falling into said selecting passageways that are further away than said predetermined distance from said wall away from said wall.

14. An apparatus as defined in claim 13, wherein said selecting body proximal and distal portions each define a substantially planar surface, said substantially planar surfaces merging at an apex, said collector being pivotally mounted to said selecting element substantially adjacent said apex.

15. An apparatus for processing a stream of non-consolidated material, said apparatus being usable with a source of pressurized fluid, said apparatus comprising a pair of substantially upstanding casings, each defining a casing inlet, a casing outlet and a proximal chamber extending therebetween, said casing inlet being located above said casing outlet; a distributor located above said casing inlets for receiving said stream of non-consolidated material and distributing said stream of non-consolidated material substantially uniformly over said casing inlet, said distributor including a distributor inlet section, distributor first and second outlet sections each leading to a respective one of said casing inlets and a distributor intermediate section extending between said distributor inlet section and said distributor first and second outlet sections, said distributor intermediate section defining a plurality of distributor passageways extending between said distributor inlet and outlet sections, a first subset of said distributor passageways extending between said distributor inlet section and said distributor first outlet section and a second subset of said distributor passageways extending between said distributor inlet section and said distributor second outlet section; and a pair of propulsive elements, said propulsive elements defining each a propulsive element inlet couplable in fluid communication with said source of pressurized fluid for receiving said pressurized fluid and a propulsive element outlet for releasing a jet of fluid when said propulsive element inlet receives said pressurized fluid, each of said propulsive element being operatively coupled to a respective one of said casings for releasing said jet of fluid in said proximal chamber.

16. An apparatus for processing a stream of non-consolidated material, said apparatus being usable with a source of pressurized fluid, said apparatus comprising:

a substantially upstanding casing, said casing defining a casing inlet, a casing outlet and a proximal chamber extending therebetween, said casing inlet being located above said casing outlet;

a distributor located above said casing inlet for receiving said stream of non-consolidated material and distributing said stream of non-consolidated material substantially uniformly over said casing inlet;

a propulsive element, said propulsive element defining a propulsive element inlet couplable in fluid communication with said source of pressurized fluid for receiving said pressurized fluid, said propulsive element defining a propulsive element outlet for releasing a jet of fluid when said propulsive element inlet receives said pressurized fluid, said propulsive element being operatively coupled to said casing for releasing said jet of fluid in said proximal chamber; wherein said propulsive element includes a propulsive element passageway extending between said propulsive element inlet and outlet;

said propulsive element outlet including two main outlets in fluid communication with said propulsive element passageway and located substantially opposed to said propulsive element inlet relative to said propulsive element passageway, said two main outlets being configured and sized such that said two main outlets release each a respective main jet portion part of said jet of fluid when said pressurized fluid is injected in said propulsive element inlet, said two main jet portions being each substantially divergent, said two main jet portions creating a low pressure zone therebetween; and an auxiliary outlet located between said two main outlets, said auxiliary outlet being in fluid communication with said propulsive element passageway and located substantially opposed to said propulsive element inlet relative to said propulsive element passageway, said auxiliary outlet being configured and sized such that said auxiliary outlet releases an auxiliary jet portion also part of said jet of fluid when said pressurized fluid is injected in said inlet, said auxiliary jet portion being released in said low pressure zone;

wherein said auxiliary jet portion has a flow rate, a velocity, a configuration and dimensions such that forces exerted on said two main jet portions by said low pressure zone are reduced by the release of said auxiliary jet portion in said low pressure zone so as to reduce turbulence in said two main jet portions substantially adjacent to said two main outlets.

* * * * *